US011982277B2

(12) United States Patent
Lee et al.

(10) Patent No.: US 11,982,277 B2
(45) Date of Patent: May 14, 2024

(54) SCROLL COMPRESSOR

(71) Applicant: Hanon Systems, Daejeon (KR)

(72) Inventors: Kyung Jae Lee, Daejeon (KR); Jeong Ki Seo, Daejeon (KR)

(73) Assignee: HANON SYSTEMS, Daejeon (KR)

( * ) Notice: Subject to any disclaimer, the term of this patent is extended or adjusted under 35 U.S.C. 154(b) by 0 days.

(21) Appl. No.: 17/757,863

(22) PCT Filed: Mar. 17, 2021

(86) PCT No.: PCT/KR2021/003307

§ 371 (c)(1),
(2) Date: Jun. 22, 2022

(87) PCT Pub. No.: WO2021/194154

PCT Pub. Date: Sep. 30, 2021

(65) Prior Publication Data

US 2023/0042489 A1 Feb. 9, 2023

(30) Foreign Application Priority Data

Mar. 23, 2020 (KR) ..... 10-2020-0035216
Mar. 8, 2021 (KR) ..... 10-2021-0030308

(51) Int. Cl.

| | |
|---|---|
| ***F04C 29/00*** | (2006.01) |
| ***F04C 18/02*** | (2006.01) |
| ***F04C 23/00*** | (2006.01) |
| ***F04C 27/00*** | (2006.01) |

(Continued)

(52) U.S. Cl.
CPC ..... *F04C 29/042* (2013.01); *F04C 18/0215* (2013.01); *F04C 23/008* (2013.01);
(Continued)

(58) Field of Classification Search
CPC ..... F04C 18/0215; F04C 2240/30; F04C 23/008; F04C 29/042; F04C 29/124;
(Continued)

(56) References Cited

U.S. PATENT DOCUMENTS

2005/0249608 A1* 11/2005 Tagami ..... F04B 27/1081 417/559
2015/0192124 A1 7/2015 Suitou et al.
(Continued)

FOREIGN PATENT DOCUMENTS

EP 0508293 A1 * 10/1992 ..... F04V 29/08
JP 2001132629 A * 5/2001 ..... F04B 27/1009
(Continued)

*Primary Examiner* — Wesley G Harris
(74) *Attorney, Agent, or Firm* — Shumaker, Loop & Kendrick, LLP; James D. Miller

(57) ABSTRACT

A scroll compressor including a housing, a motor provided in the housing, a rotary shaft rotated by the motor, an orbiting scroll configured to orbit in conjunction with the rotary shaft, and a fixed scroll configured to define compression chambers together with the orbiting scroll, in which the housing includes a center housing penetrated by the rotary shaft, a front housing configured to define, together with the center housing, a motor accommodation space that accommodates the motor, and a rear housing configured to define a discharge chamber that accommodates a refrigerant discharged from the compression chamber, and an injection valve assembly provided between the fixed scroll and the rear housing, and the injection valve assembly includes an anti-leakage means and an injection valve configured to open or close an injection flow path that guides the refrigerant, which is introduced from outside of the housing, to the compression chamber.

19 Claims, 18 Drawing Sheets

(51) Int. Cl. *F04C 29/04* (2006.01) *F04C 29/12* (2006.01)

(52) U.S. Cl.
CPC ..... *F04C 27/008* (2013.01); *F04C 29/0007* (2013.01); *F04C 29/128* (2013.01); *F04C 2230/603* (2013.01); *F04C 2240/30* (2013.01)

(58) Field of Classification Search
CPC .. F04C 29/128; F04C 27/008; F04C 29/0007; F04B 39/1066; F04B 27/1081
See application file for complete search history.

(56) References Cited

U.S. PATENT DOCUMENTS

| | | | | |
|---|---|---|---|---|
| 2015/0192127 | A1* | 7/2015 | Nagano | F04C 28/24 417/410.5 |
| 2021/0285445 | A1* | 9/2021 | Bhatia | F04C 18/0261 |
| 2022/0042503 | A1* | 2/2022 | Ahn | F04B 39/1066 |
| 2022/0268282 | A1* | 8/2022 | Lee | F04C 18/0261 |

FOREIGN PATENT DOCUMENTS

| | | | | |
|---|---|---|---|---|
| JP | 2013155679 | A | 8/2013 | |
| JP | 2015129475 | A | 7/2015 | |
| JP | 2015129477 | A | 7/2015 | |
| JP | 2020002947 | A | 1/2020 | |
| KR | 101952373 | A | 2/2019 | |
| KR | 101952373 | B1 | 2/2019 | |
| KR | 20200053989 | A * | 5/2020 | F04C 18/02 |
| WO | WO-2021040271 | A1 * | 3/2021 | F04C 18/0215 |
| WO | WO-2021167288 | A1 * | 8/2021 | F04C 18/0215 |

* cited by examiner

FIG. 1 - Prior Art
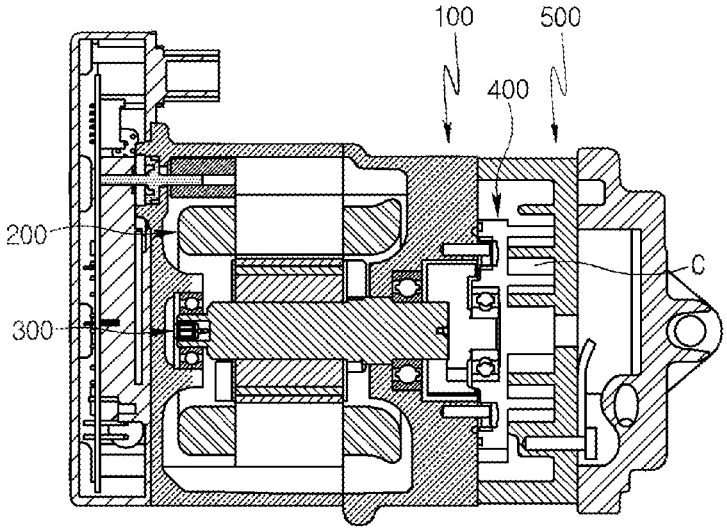
FIG. 2
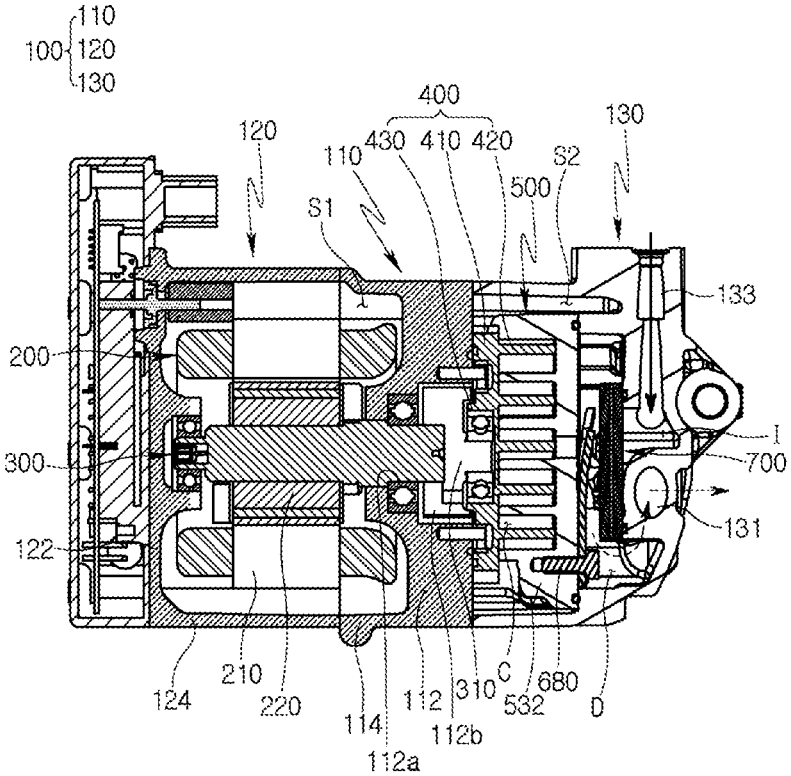

SCROLL COMPRESSOR

CROSS REFERENCE TO RELATED APPLICATIONS

This is a U.S. national phase patent application of PCT/KR2021/003307 filed Mar. 17, 2021 which claims the benefit of and priority to Korean Pat. Appl. No. 10-2021-0030308 filed on Mar. 8, 2021 and Korean Pat. Appl. No. 10-2020-0035216 filed on Mar. 23, 2020, the entire contents of each of which are incorporated herein by reference.

TECHNICAL FIELD

The present disclosure relates to a scroll compressor, and more particularly, to a scroll compressor capable of compressing a refrigerant by using a fixed scroll and an orbiting scroll.

BACKGROUND ART

In general, an air conditioning (A/C) device is installed in a vehicle to cool or heat the interior of the vehicle. The air conditioning device includes a compressor which is a component of a cooling system, and the compressor compresses a low-temperature and low-pressure gaseous refrigerant introduced from an evaporator to make a high-temperature and high-pressure gaseous refrigerant and delivers the refrigerant to a condenser.

The compressors are classified into a reciprocating compressor which compresses a refrigerant using a reciprocating motion of a piston, and a rotary compressor which compresses a refrigerant using a rotational motion. Depending on methods of transmitting driving power, the reciprocating compressors are classified into a crank compressor which transmits power to a plurality of pistons using a crank, and a swash plate compressor which transmits power to a shaft on which a swash plate is installed. The rotary compressors are classified into a vane rotary compressor which uses a rotating rotary shape and vanes, and a scroll compressor which uses an orbiting scroll and a fixed scroll.

The scroll compressor has an advantage in that the scroll compressor may obtain a relatively higher compression ratio than other compressors, smoothly perform processes of introducing, compressing, and discharging the refrigerant, and thus obtain stable torque. Therefore, the scroll compressor is widely used to compress the refrigerant in an air conditioning device or the like.

FIG. 1 is a cross-sectional view illustrating a scroll compressor in the related art.

Referring to the accompanying FIG. 1, a scroll compressor in the related art includes a housing 100, a motor 200 provided in the housing 100, a rotary shaft 300 configured to be rotated by the motor 200, an orbiting scroll 400 configured to orbit in conjunction with the rotary shaft 300, and a fixed scroll 500 configured to define a compression chamber C together with the orbiting scroll 400.

According to the scroll compressor in the related art configured as described above, when power is applied to the motor 200, the rotary shaft 300 rotates together with a rotor of the motor 200, the orbiting scroll 400 orbits in conjunction with the rotary shaft 300, and a refrigerant is introduced into and compressed in the compression chamber C by the orbiting motion of the orbiting scroll 400 and then discharged from the compression chamber C. The series of processes are repeated.

However, the scroll compressor in the related art has a problem in that a discharge amount of the refrigerant to be discharged from the compression chamber C is determined, which causes a limitation in improving the performance and efficiency of the compressor.

SUMMARY

An object of the present disclosure is to provide a scroll compressor capable of improving performance and efficiency of the compressor by increasing the amount of refrigerant to be discharged from a compression chamber.

Technical problems to be solved by the present disclosure are not limited to the above-mentioned technical problems, and other technical problems, which are not mentioned above, may be clearly understood from the following descriptions by those skilled in the art to which the present disclosure pertains.

To achieve the above-mentioned object, an embodiment of the present disclosure provides a scroll compressor including: a housing; a motor provided in the housing; a rotary shaft configured to be rotated by the motor; an orbiting scroll configured to orbit in conjunction with the rotary shaft; and a fixed scroll configured to define compression chambers together with the orbiting scroll, in which the housing includes: a center housing penetrated by the rotary shaft; a front housing configured to define, together with the center housing, a motor accommodation space that accommodates the motor; and a rear housing configured to define a discharge chamber that accommodates a refrigerant discharged from the compression chamber, and in which an injection valve assembly is provided between the fixed scroll and the rear housing, and the injection valve assembly includes an anti-leakage means and an injection valve configured to open or close an injection flow path that guides the refrigerant, which is introduced from the outside of the housing, to the compression chamber.

According to the embodiment of the present disclosure, the injection valve assembly may further include: a cover plate coupled to the rear housing and having an inflow port into which the refrigerant is introduced; and a valve plate coupled to the cover plate and having an outflow port through which the refrigerant introduced through the inflow port is discharged, the anti-leakage means may include a gasket retainer interposed between the cover plate and the valve plate, and the injection valve may be interposed between the cover plate and the gasket retainer and configured to open or close the inflow port.

According to the embodiment of the present disclosure, the gasket retainer may include a bead portion protruding from a gasket retainer upper surface facing the cover plate, and the bead portion surrounds the injection valve.

According to the embodiment of the present disclosure, the introduced refrigerant may be introduced into the front housing and introduced into the compression chamber, and at least a part of the refrigerant discharged to the outside of the housing may be introduced in a middle-pressure state from the outside of the housing and introduced into the compression chamber through the injection flow path.

According to the embodiment of the present disclosure, the gasket retainer and the injection valve may be compressed between the cover plate and the valve plate.

According to the embodiment of the present disclosure, when the gasket retainer and the injection valve are assembled between the cover plate and the valve plate, the bead portion may be pressed by the cover plate in a direction toward the valve plate, and an inner portion of the gasket retainer, which faces the injection valve, may be bent in a direction toward the injection valve.

According to the embodiment of the present disclosure, a gap between the injection valve and the cover plate after the bead portion may be pressed is smaller than a gap between the injection valve and the cover plate before the bead portion is pressed.

According to the embodiment of the present disclosure, a height h by which the bead portion protrudes may be equal to or larger than a thickness t of the injection valve.

According to the embodiment of the present disclosure, the gasket retainer may further include one or more retainer portions inclined in a direction in which the injection valve is opened.

According to the embodiment of the present disclosure, the gasket retainer may further include: a third fastening hole penetratively formed in an outer portion of the bead portion based on a radial direction so that a fastening bolt is inserted into the third fastening hole; and a third positioning hole penetratively formed in an inner portion of the bead portion based on the radial direction so that a positioning pin is inserted into the third positioning hole.

According to the embodiment of the present disclosure, the valve plate may include one or more inclined spaces that correspond to the one or more retainer portions and accommodates the refrigerant introduced through the inflow port.

According to the embodiment of the present disclosure, the fixed scroll may include an injection port configured to guide the refrigerant, which is discharged from the outflow port, to the compression chamber, and the outflow port may guide the refrigerant in the inclined space to the injection port.

According to the embodiment of the present disclosure, the inflow port may include a first inflow port; and a second inflow port formed independently of the first inflow port, the injection valve may include: a first head portion configured to open or close the first inflow port; a first leg portion configured to support the first head portion; a second head portion configured to open or close the second inflow port; a second leg portion configured to support the second head portion; and a connection portion configured to connect the first leg portion and the second leg portion, the retainer portion may include: a first retainer portion configured to support the first head portion and the first leg portion when the injection valve opens the inflow port; and a second retainer portion configured to support the second head portion and the second leg portion, and the inclined space may include: a first inclined space configured to accommodate the refrigerant introduced through the first inflow port; and a second inclined space configured to accommodate the refrigerant introduced through the second inflow port.

According to the embodiment of the present disclosure, a connected portion between the first leg portion and the connection portion and a connected portion between the second leg portion and the connection portion may be formed at opposite sides.

According to the embodiment of the present disclosure, the inflow port may include: a first inflow port; and a second inflow port formed independently of the first inflow port, the injection valve may include: a first head portion configured to open or close the first inflow port; a first leg portion configured to support the first head portion; a second head portion configured to open or close the second inflow port; a second leg portion configured to support the second head portion; and a connection portion configured to connect the first leg portion and the second leg portion, the retainer portion may be configured as a single retainer portion configured to support the first head portion, the first leg portion, the second head portion, and the second leg portion when the injection valve opens the inflow port, and the inclined space may be configured as a single inclined space configured to accommodate the refrigerant introduced through the first inflow port and the second inflow port.

According to the embodiment of the present disclosure, a connected portion between the first leg portion and the connection portion and a connected portion between the second leg portion and the connection portion may be formed at the same side.

According to the embodiment of the present disclosure, the retainer portion may be inclined by a cut-out portion in a body of the gasket retainer.

According to the embodiment of the present disclosure, the gasket retainer may include one or more blade portions configured to connect the retainer portion and the body of the gasket retainer that faces the retainer portion.

According to the embodiment of the present disclosure, the retainer portion may be inclined by a cut-out portion in a body of the gasket retainer, and the gasket retainer may further include a pair of blade portions configured to connect two opposite sides of the retainer portion and the body of the gasket retainer that faces the two opposite sides of the retainer portion.

According to the embodiment of the present disclosure, a main flow hole may be formed at one side of the pair of blade portions, and a pair of auxiliary flow holes each having a straight shape may be formed at the other side of the pair of blade portions.

According to the present disclosure, not only the suction-pressure refrigerant but also the middle-pressure refrigerant is introduced into the compression chamber C of the scroll compressor, such that the amount of refrigerant to be discharged from the compression chamber may increase, which makes it possible to improve performance and efficiency of the compressor.

In addition, the injection valve assembly may include the anti-leakage means together with the injection valve for opening or closing the injection flow path for guiding the refrigerant to the pressure chamber from the outside of the housing, thereby preventing a leakage of the refrigerant through the injection valve assembly.

Specifically, the bead portion of the gasket retainer protrudes toward the cover plate. Further, when the gasket retainer and the injection valve are assembled between the cover plate and the valve plate, the bead portion is pressed by the cover plate in the direction toward the valve plate. Further, the inner portion of the gasket retainer, which faces the injection valve, may be bent in the direction opposite to the direction in which the bead portion is pressed, i.e., bent in the direction toward the injection valve. Therefore, the inner portion of the gasket retainer may be in close contact with the injection valve so as to seal the injection valve, thereby preventing a leak of the refrigerant.

The effects of the present disclosure are not limited to the above-mentioned effects, and it should be understood that the effects of the present disclosure include all effects that may be derived from the detailed description of the present disclosure.

DESCRIPTION OF DRAWINGS

FIG. 1 is a cross-sectional view illustrating a scroll compressor in the related art.

FIG. 2 is a cross-sectional view illustrating a scroll compressor according to an embodiment of the present disclosure.

DESCRIPTION OF AN EMBODIMENT

Figure 3:
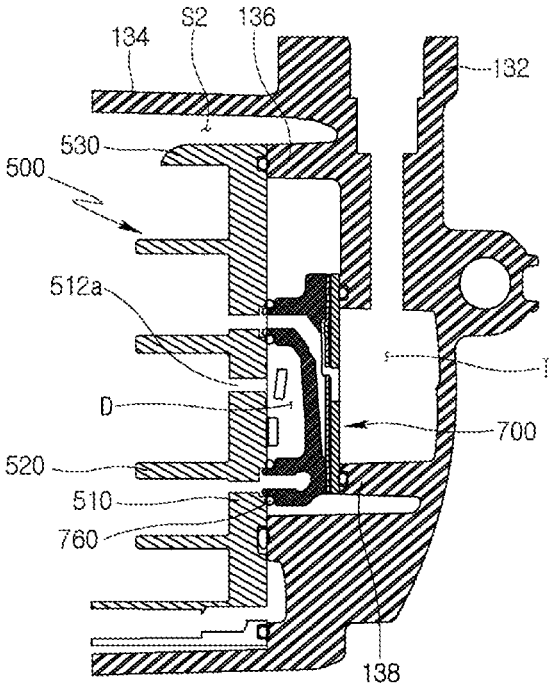
FIG. 3 is a cross-sectional view illustrating a rear housing of the scroll compressor illustrated in FIG. 2 when viewed in another direction.
Figure 4:
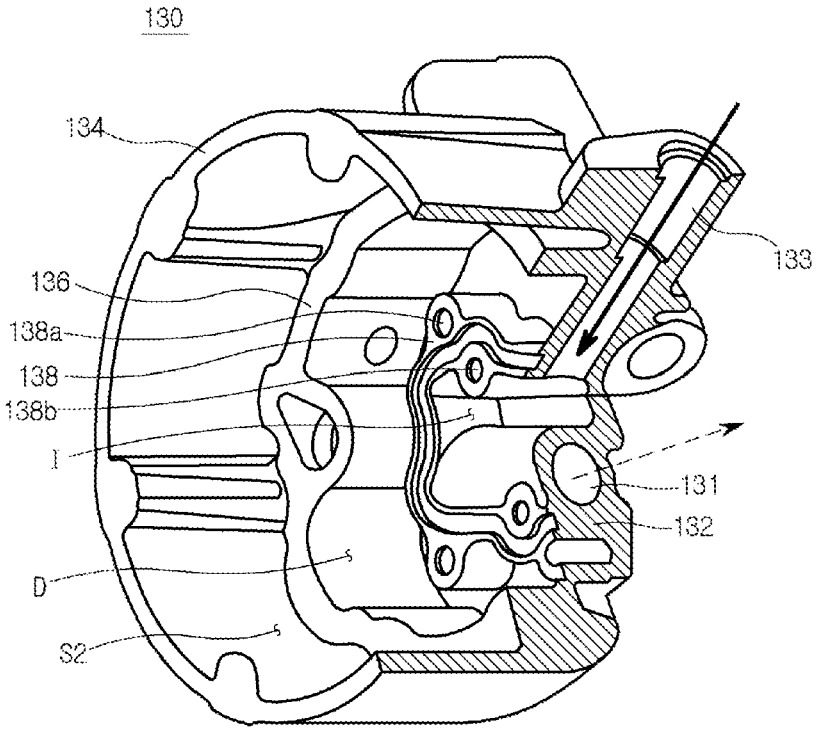
FIG. 4 is a partially cross-sectional perspective view illustrating a state in which the rear housing is separated from the scroll compressor illustrated in FIG. 2.
Figure 5:
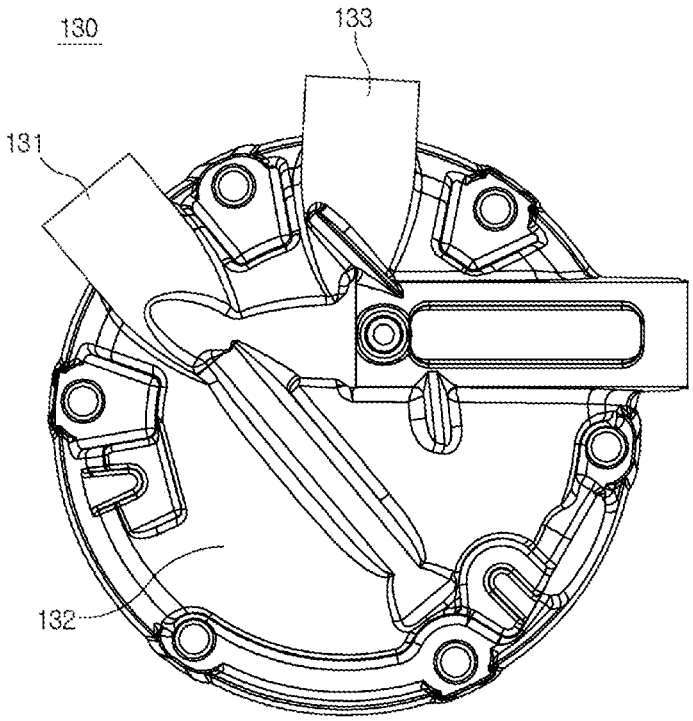
FIG. 5 is a front view illustrating a state in which the rear housing is separated from the scroll compressor illustrated in FIG. 2.
Figure 6:
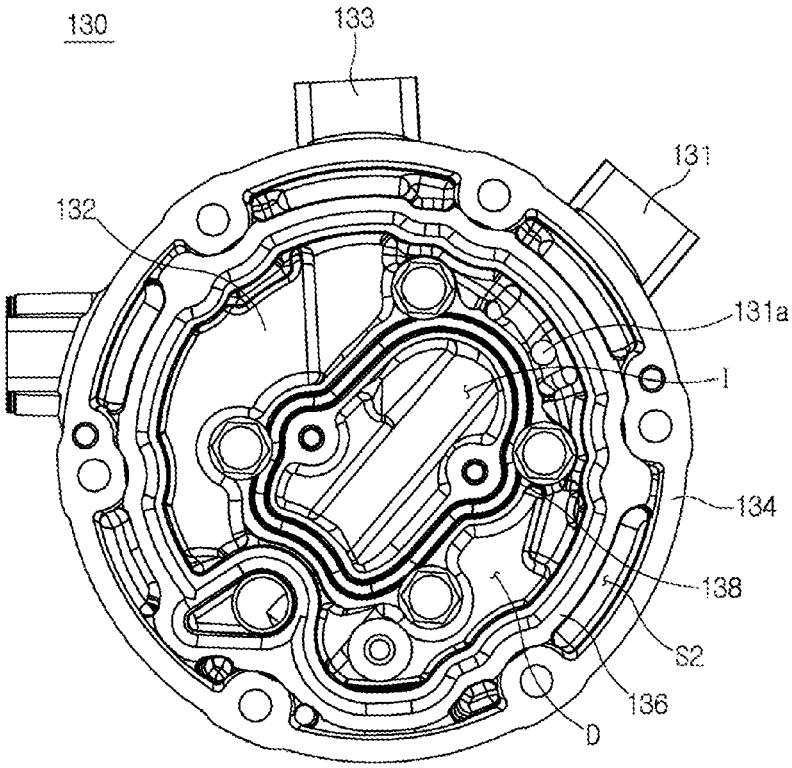
FIG. 6 is a rear view of FIG. 5.

Hereinafter, exemplary embodiments of a scroll compressor according to the present disclosure will be described with reference to the accompanying drawings.

In addition, the terms used below are defined considering the functions in the present disclosure and may vary depending on the intention of a user or an operator or a usual practice. The following embodiments are not intended to limit the protection scope of the present disclosure but just exemplary constituent elements.

A part irrelevant to the description will be omitted to clearly describe the present disclosure, and the same or similar constituent elements will be designated by the same reference numerals throughout the specification. Throughout the specification, unless explicitly described to the contrary, the word "comprise/include" and variations such as "comprises/includes" or "comprising/including" will be understood to imply the inclusion of stated elements, not the exclusion of any other elements.

First, a scroll compressor according to an embodiment of the present disclosure will be described with reference to FIGS. 2 to 6 and 17 to 22.

As illustrated in FIG. 2, the scroll compressor according to the embodiment of the present disclosure may include a housing 100, a motor 200 provided in the housing 100, a rotary shaft 300 configured to be rotated by the motor 200, an orbiting scroll 400 configured to orbit in conjunction with the rotary shaft 300, a fixed scroll 500 configured to define compression chambers C together with the orbiting scroll 400, and a discharge valve 600 disposed on one surface of the fixed scroll 500 and configured to open or close discharge openings 512 of the fixed scroll from which a refrigerant compressed in the compression chamber C is discharged.

Further, the compressor according to the present embodiment may further include an injection valve assembly 700 that defines and opens or closes an injection flow path configured to guide a middle-pressure refrigerant to the compression chamber C from the outside of the housing 100 (e.g., from a downstream side of a condenser in a vapor compression refrigeration cycle including a scroll compressor, the condenser, an expansion valve, and an evaporator).

In this case, the injection flow path includes an introduction port 133, an introduction chamber I, an inflow port 712, an inclined space 734, an outflow port 736, and an injection port 514. The injection flow path extends from a rear housing 130 to the fixed scroll 500. The injection valve assembly 700 includes the inflow port 712, the inclined space 734, and the outflow port 736 and may be interposed between the rear housing 130 and the fixed scroll 500.

Specifically, the housing 100 may include a center housing 110 penetrated by the rotary shaft 300, a front housing 120 configured to define, together with the center housing 110, a motor accommodation space S1 that accommodates the motor 200, and the rear housing 130 configured to define, together with the center housing 110, a scroll accommodation space S2 that accommodates the orbiting scroll 400 and the fixed scroll 500.

The center housing 110 may include a center end plate 112 configured to separate the motor accommodation space S1 and the scroll accommodation space S2 and support the orbiting scroll 400 and the fixed scroll 500, and a center side plate 114 protruding from an outer peripheral portion of the center end plate 112 toward the front housing 120.

The center end plate 112 has an approximately circular plate shape. A bearing hole 112*a* penetrated by one end of the rotary shaft 300 may be formed in a central portion of the center end plate 112. A back pressure chamber 112*b* configured to press the orbiting scroll 400 toward the fixed scroll 500 may be formed in the central portion of the center end plate 112. In this case, an eccentric bushing 310 is provided at one end of the rotary shaft 300 and converts a rotational motion of the rotary shaft 300 into an orbiting motion of the orbiting scroll 400. The back pressure chamber 112*b* sometimes provides a space in which the eccentric bushing 310 may rotate. Further, as described below, a suction flow path (not illustrated) may be formed on an outer peripheral portion of the center end plate 112 and guide the refrigerant, which is introduced into the motor accommodation space S1, to the scroll accommodation space S2.

The front housing 120 may include a front end plate 122 configured to face the center end plate 112 and support the other end of the rotary shaft 300, and a front side plate 124 protruding from an outer peripheral portion of the front end plate 122, fastened to the center side plate 114, and configured to support the motor 200. In this case, the center end plate 112, the center side plate 114, the front end plate 122, and the front side plate 124 may define the motor accommodation space S1. Further, a suction port (not illustrated) may be formed in the front side plate 124 and guide the refrigerant with a suction pressure to the motor accommodation space S1 from the outside.

As illustrated in FIGS. 3 to 6, the rear housing 130 may include a rear end plate 132 configured to face the center end plate 112, a first annular wall 134 protruding from the rear end plate 132 and positioned at an outermost peripheral side of the rear housing 130 based on a circumferential direction of the rear housing 130, a second annular wall 136 protruding from the rear end plate 132 and accommodated in the first annular wall 134, and a third annular wall 138 protruding from the rear end plate 132 and accommodated in the second annular wall 136. The first annular wall 134, the second annular wall 136, and the third annular wall 138 may have different heights.

The first annular wall 134 may have an annular shape having a diameter approximately equal in level to a diameter of the outer peripheral portion of the center end plate 112. The first annular wall 134 may be fastened to the outer peripheral portion of the center end plate 112 and define the scroll accommodation space S2.

The second annular wall 136 has an annular shape having a diameter smaller than a diameter of the first annular wall 134. The second annular wall 136 may come into contact with an outer peripheral portion of a fixed end plate 510 of the fixed scroll 500 to be described below. The second annular wall 136 may define a discharge chamber D that accommodates the refrigerant discharged from the compression chamber C. In this case, since the second annular wall 136 is formed to come into contact with the fixed end plate 510, the rear housing 130 may press the fixed scroll 500 toward the center housing 110 when the rear housing 130 is fastened to the center housing 110, thereby improving a fastening force between the fixed scroll 500 and the center housing 110 and preventing a leak between the fixed scroll 500 and the center housing 110.

The third annular wall 138 has an annular shape having a diameter smaller than a diameter of the second annular wall 136 and is spaced apart from the fixed end plate 510. The third annular wall 138 may be covered by a cover plate 710 of the injection valve assembly 700 to be described below, thereby defining the introduction chamber I that accommodates the refrigerant introduced through the introduction port 133.

A discharge port 131 is formed in the rear end plate 132 and guides the refrigerant in the discharge chamber D to the outside of the housing 100. The discharge port 131 may extend in a radial direction of the rear end plate 132 from a central portion of the rear end plate 132 to one side of an outer peripheral portion of the rear end plate 132. Further, a discharge port inlet 131*a* may be formed in the rear end plate 132 and guide the refrigerant in the discharge chamber D to the discharge port 131.

Meanwhile, a tubular oil separator (not illustrated) may be provided in the discharge port 131 and separate oil from the refrigerant. The oil separator may separate the oil from the refrigerant in a process in which the refrigerant introduced into the discharge port inlet 131*a* flows toward a center of the rear end plate 132 along a space between an outer peripheral surface of the oil separator and an inner peripheral surface of the discharge port 131, changes in direction, and then is discharged to one side of the outer peripheral portion of the rear end plate 132 along an inner peripheral portion of the oil separator.

In addition, the introduction port 133 is also formed in the rear end plate 132, and the middle-pressure refrigerant is introduced into the introduction port 133 from the outside of the housing 100. The introduction port 133 may extend in the radial direction of the rear end plate 132 from the other side of the outer peripheral portion of the rear end plate 132 to the central portion of the rear end plate 132 and communicate with the introduction chamber I.

As described above, the rear housing 130 may have the discharge chamber D, the discharge port 131, the introduction port 133, and the introduction chamber I. At least a part of the introduction chamber I may be accommodated in the discharge chamber D, at least a part of the discharge port 131 may be accommodated in the introduction chamber I, and at least a part of the introduction port 133 may be accommodated in the discharge chamber D.

Specifically, at least a part of the introduction chamber I may be accommodated in the discharge chamber D when the third annular wall 138 is accommodated in the second annular wall 136 and the third annular wall 138 is spaced apart from the fixed end plate 510 and covered by the injection valve assembly 700. That is, a lateral portion of the introduction chamber I may overlap the discharge chamber D in the radial direction of the rear housing 130 with the third annular wall 138 interposed therebetween. A tip portion of the introduction chamber I may overlap the discharge chamber D in an axial direction of the rear housing 130 with the injection valve assembly 700 interposed therebetween.

In addition, since the discharge port 131 extends in the radial direction of the rear end plate 132 from the central portion of the rear end plate 132 to one side of the outer peripheral portion of the rear end plate 132, at least a part of the discharge port 131 may be accommodated in the introduction chamber I. That is, at least a part of the discharge port 131 may overlap the introduction chamber I in the axial direction of the rear housing 130 with a wall portion of the discharge port 131 interposed therebetween.

In addition, since the introduction port 133 extends in the radial direction of the rear end plate 132 from the other side of the outer peripheral portion of the rear end plate 132 to the central portion of the rear end plate 132, at least a part of the introduction port 133 may be accommodated in the discharge chamber D. That is, at least a part of the introduction port 133 may overlap the discharge chamber D in the axial direction of the rear housing 130 with a wall portion of the introduction port 133.

Meanwhile, the discharge port 131 and the introduction port 133 may be formed such that the refrigerant in the discharge port 131 and the refrigerant in the introduction port 133 flow in a cross-flow direction. That is, an angle between an outlet of the discharge port 131 and an inlet of the introduction port 133 may be equal to or larger than 0° and smaller than 90° with respect to a center of the rear housing 130.

Further, the third annular wall 138 may have fastening grooves 138*a* and first positioning grooves 138*b*. Fastening bolts 770 for fastening the injection valve assembly 700 to the third annular wall 138 may be inserted into the fastening grooves 138*a*. Positioning pins 780 for aligning the cover plate 710, an injection valve 720, a gasket retainer 790, and a valve plate 730 of the injection valve assembly 700 with predetermined positions may be inserted into the first positioning grooves 138*b*.

As illustrated in FIG. 2, the motor 200 may include a stator 210 fixed to the front side plate 124, and a rotor 220 configured to be rotated in the stator 210 by an interaction with the stator 210.

The rotary shaft 300 is fastened to the rotor 220 and penetrates a central portion of the rotor 220, such that one end of the rotary shaft 300 may penetrate the bearing hole 112*a* of the center end plate 112, and the other end of the rotary shaft 300 may be supported on the front end plate 122.

The orbiting scroll 400 may be interposed between the center end plate 112 and the fixed scroll 500 and include an orbiting end plate 410 having a circular plate shape, an orbiting wrap 420 protruding from a central portion of the orbiting end plate 410 toward the fixed scroll 500, and a boss part 430 protruding from the central portion of the orbiting end plate 410 in a direction opposite to the orbiting wrap 420 and fastened to the eccentric bushing 310.

Figure 17:
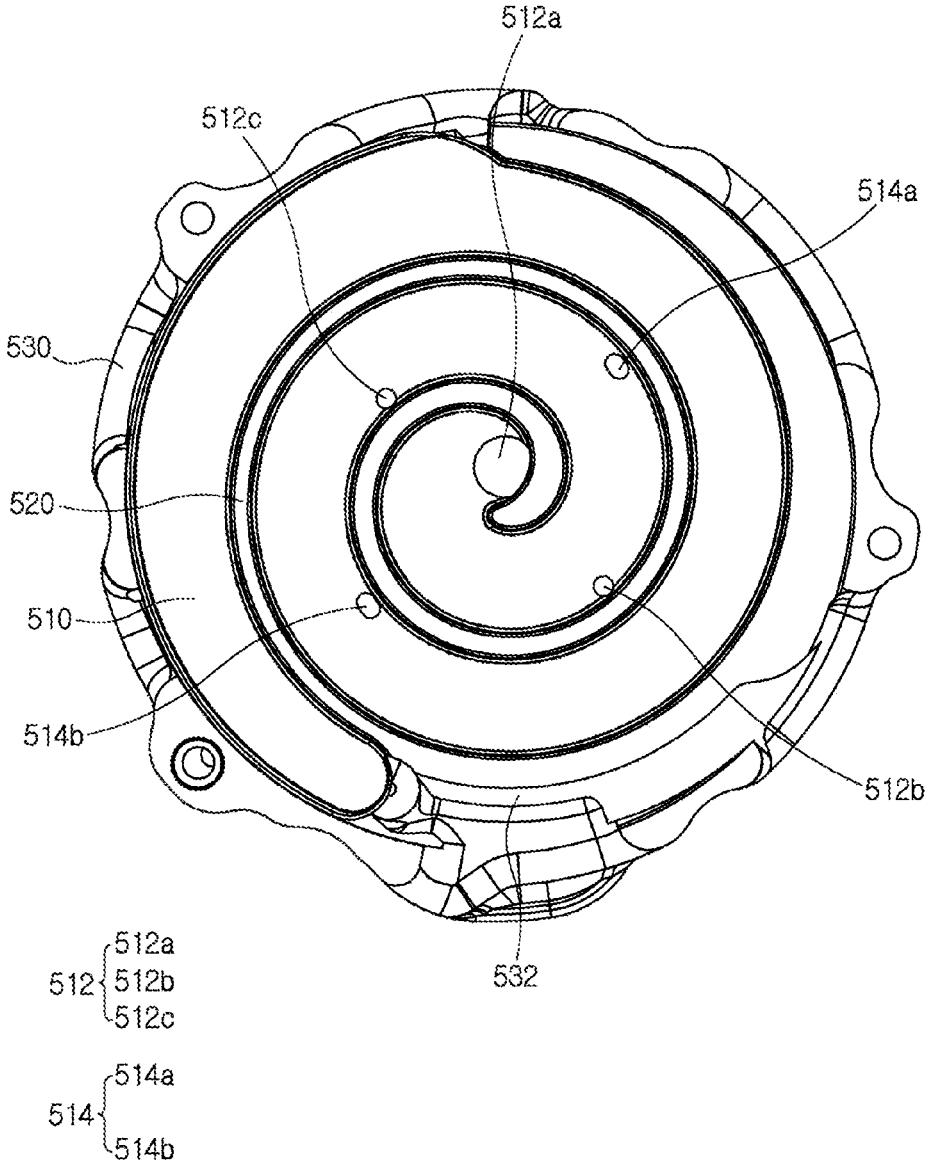
FIG. 17 is a rear view of the fixed scroll of the scroll compressor illustrated in FIG. 2.
Figure 18:
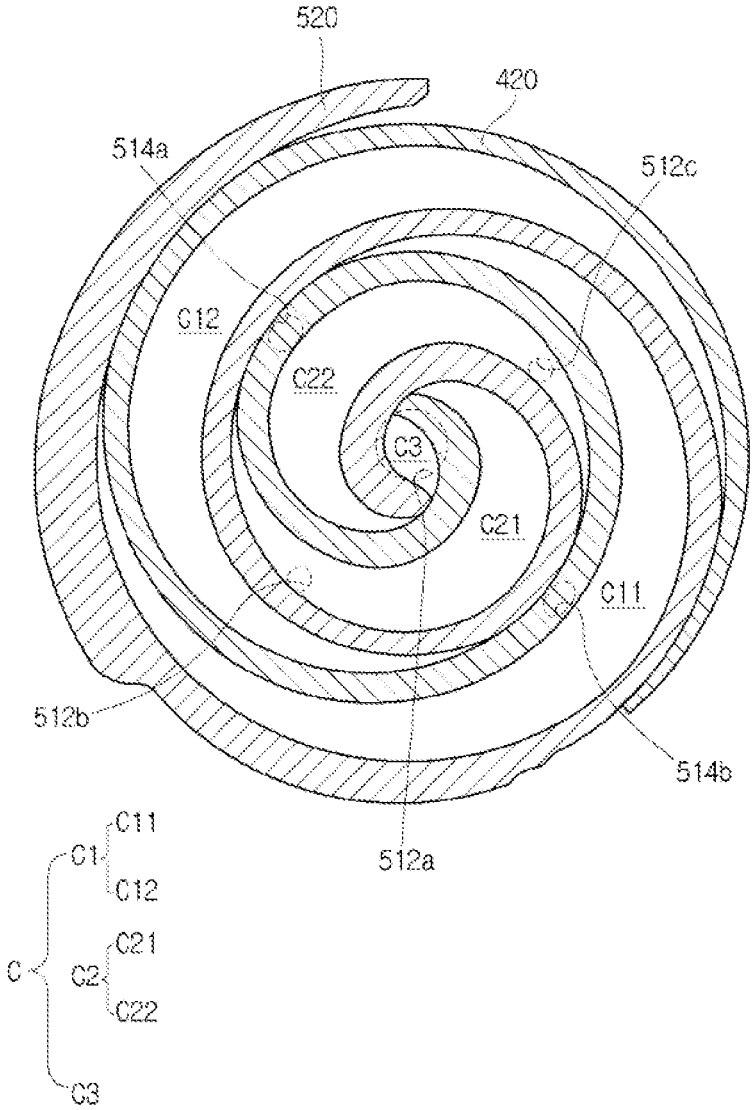
FIGS. 18 to 21 are cross-sectional views illustrating a fixed wrap, an orbiting wrap, and injection ports when a rotation angle of a rotary shaft is first, second, third, and fourth angles.
Figure 19:
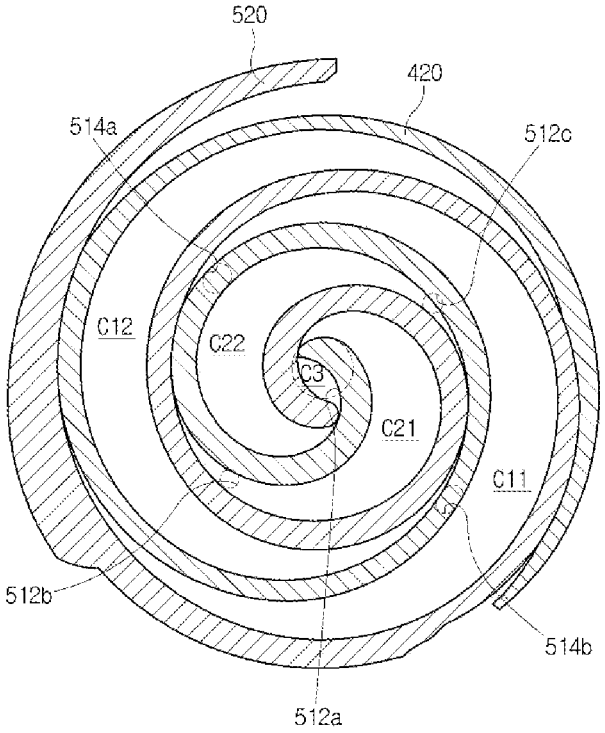
Figure 20:
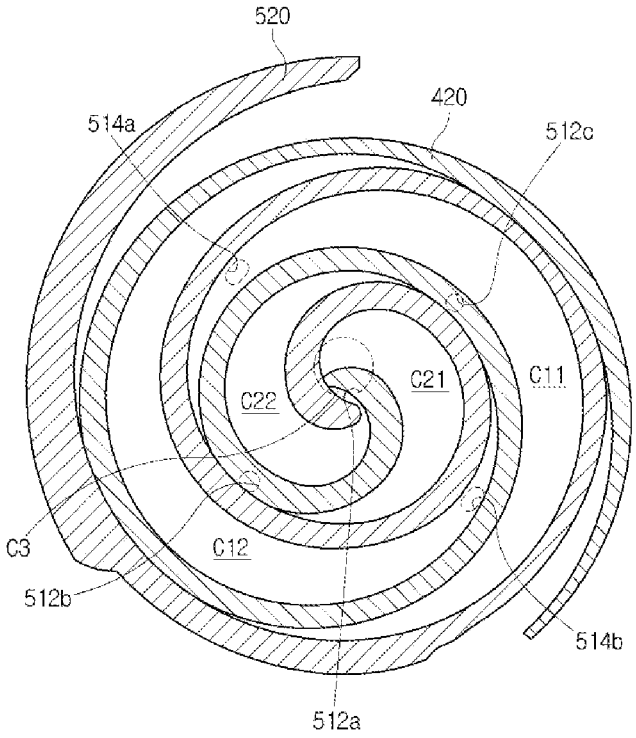
Figure 21:
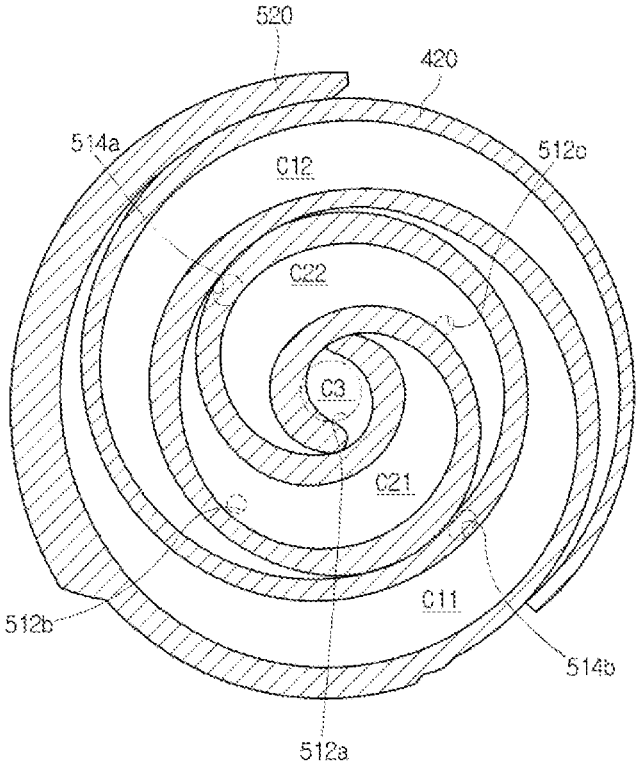

As illustrated in FIGS. 3 and 17, the fixed scroll 500 may include the fixed end plate 510 having a circular plate shape, a fixed wrap 520 protruding from a central portion of the fixed end plate 510 and configured to engage with the orbiting wrap 420, and a fixed side plate 530 protruding from an outer peripheral portion of the fixed end plate 510 and fastened to the center end plate 112.

The fixed end plate 510 may include the discharge openings 512 from which the refrigerant in the compression chamber C is discharged to the discharge chamber D, and the injection ports 514 configured to guide the refrigerant, which is discharged from the injection valve assembly 700, to the compression chamber C. The discharge opening 512 may be provided in plural to prevent the refrigerant from being excessively compressed. The plurality of discharge openings 512 may be opened or closed by the discharge valve 600 interposed between the fixed end plate 510 and the injection valve assembly 700.

Specifically, as illustrated in FIGS. 18 to 21, the compression chamber C may include a first compression chamber C1 positioned at a centrifugal side in a radial direction of the scroll accommodation space S2 and having the refrigerant at a pressure in a first pressure range, a second compression chamber C2 positioned to be closer to a centripetal side in the radial direction of the scroll accommodation space S2 than the first compression chamber C1 to the centripetal side and having the refrigerant at a pressure in a second pressure range higher than the first pressure range, and a third compression chamber C3 positioned to be closer to the centripetal side in the radial direction of the scroll accommodation space S2 than the second compression chamber C2 to the centripetal side and having the refrigerant at a pressure in a third pressure range higher than the second pressure range.

The first compression chambers C1 may include a first outer compression chamber C11 defined by an outer peripheral surface of the orbiting wrap 420 and an inner peripheral surface of the fixed wrap 520, and a first inner compression chamber C12 defined by an inner peripheral surface of the orbiting wrap 420 and an outer peripheral surface of the fixed wrap 520.

The second compression chambers C2 may include a second outer compression chamber C21 defined by the outer peripheral surface of the orbiting wrap 420 and the inner peripheral surface of the fixed wrap 520, and a second inner compression chamber C22 defined by the inner peripheral surface of the orbiting wrap 420 and the outer peripheral surface of the fixed wrap 520.

In this case, the discharge openings 512 may include a main discharge opening 512*a* formed adjacent to a center of the fixed end plate 510 to discharge the refrigerant in the third compression chamber C3, a first sub-discharge opening 512*b* formed outside the main discharge opening 512*a* in a radial direction of the fixed end plate 510 to discharge the refrigerant in the second outer compression chamber C21, and a second sub-discharge opening 512*c* formed outside the main discharge opening 512*a* in the radial direction of the fixed end plate 510 and disposed opposite to the first sub-discharge opening 512*b* based on the main discharge opening 512*a* to discharge the refrigerant in the second inner compression chamber C22.

In addition, the injection port 514 may be provided in plural to supply the refrigerant, discharged from the injection valve assembly 700, to both the pair of first compression chambers C1. That is, the injection ports 514 may include a first injection port 514*a* that may communicate with the first outer compression chamber C11, and a second injection port 514*b* that may communicate with the first inner compression chamber C12. The first injection port 514*a* and the second injection port 514*b* may be formed opposite to each other based on an imaginary line that connects the first sub-discharge opening 512*b* and the second sub-discharge opening 512*c*. However, the present disclosure is not limited thereto, and the injection port 514 may be provided in plural, and the plurality of injection ports 514 may be formed at the same side based on an imaginary line that connects the first sub-discharge opening 512*b* and the second sub-discharge opening 512*c*.

The injection port 514 may be provided in the form of a long hole in order to increase a flow rate of the refrigerant to be injected into the compression chamber C. Further, the injection port 514 may have a constant cross-sectional shape to prevent a loss of pressure and flow rate when the refrigerant passes through the injection port 514. That is, an inner diameter of the injection port 514 may be set as a value predetermined regardless of an axial position of the injection port 514.

Figure 22:
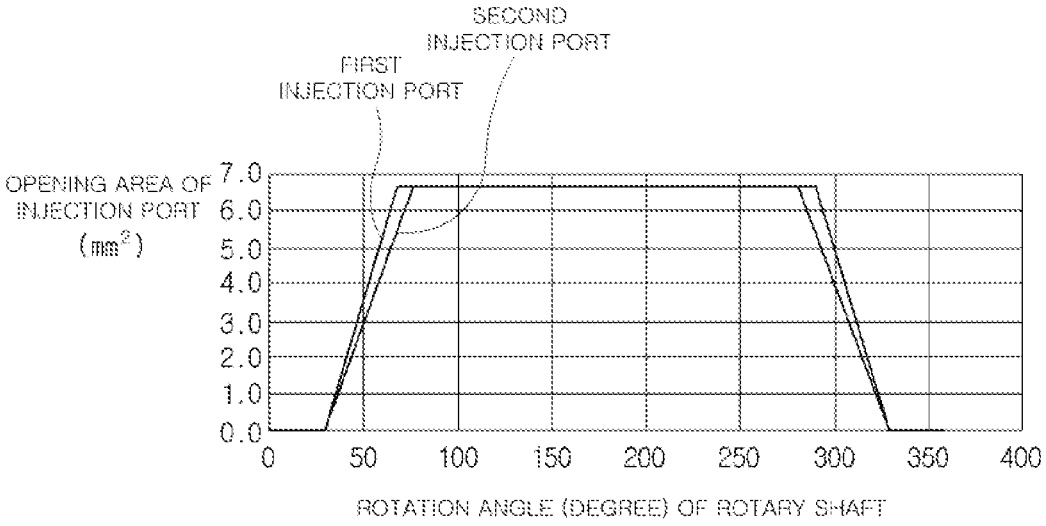
FIG. 22 is a graph illustrating a timing of opening or closing the injection ports.

In this case, the injection ports 514 may simultaneously communicate with the first outer compression chamber C11 and the first inner compression chamber C12 so that pressure imbalance does not occur between the first outer compression chamber C11 and the first inner compression chamber C12. That is, as illustrated in FIG. 22, when the communication between the first injection port 514*a* and the first outer compression chamber C11 is initiated, the communication between the second injection port 514*b* and the first inner compression chamber C12 may be initiated.

In addition, particularly, the injection ports 514 may be blocked simultaneously together with the first outer compression chamber C11 and the first inner compression chamber. That is, as illustrated in FIG. 22, when the communication between the first injection port 514*a* and the first outer compression chamber C11 is blocked, the communication between the second injection port 514*b* and the first inner compression chamber C12 may be blocked.

For example, the fixed wrap 520 may extend in a logarithmic spiral shape from a center to an outer peripheral portion of the fixed scroll 500. The fixed side plate 530 may include a fixed wrap introduction part 532 having an annular shape extending along the outer peripheral portion of the fixed end plate 510 and having one side connected to the fixed wrap 520.

An axial height of the fixed wrap introduction part 532 may be equal in level to an axial height of the fixed wrap 520 to prevent the refrigerant in the compression chamber C from leaking through the fixed wrap introduction part 532. In addition, a radial thickness of the fixed wrap introduction part 532 is larger than a radial thickness of the fixed wrap 520 to improve support rigidity of the fixed wrap 520. In this case, to reduce the weight and costs of the fixed scroll 500, the fixed side plate 530 may be formed such that a radial thickness of a portion, except for the fixed wrap introduction part 532, may be smaller than the radial thickness of the fixed wrap introduction part 532.

Figure 7:
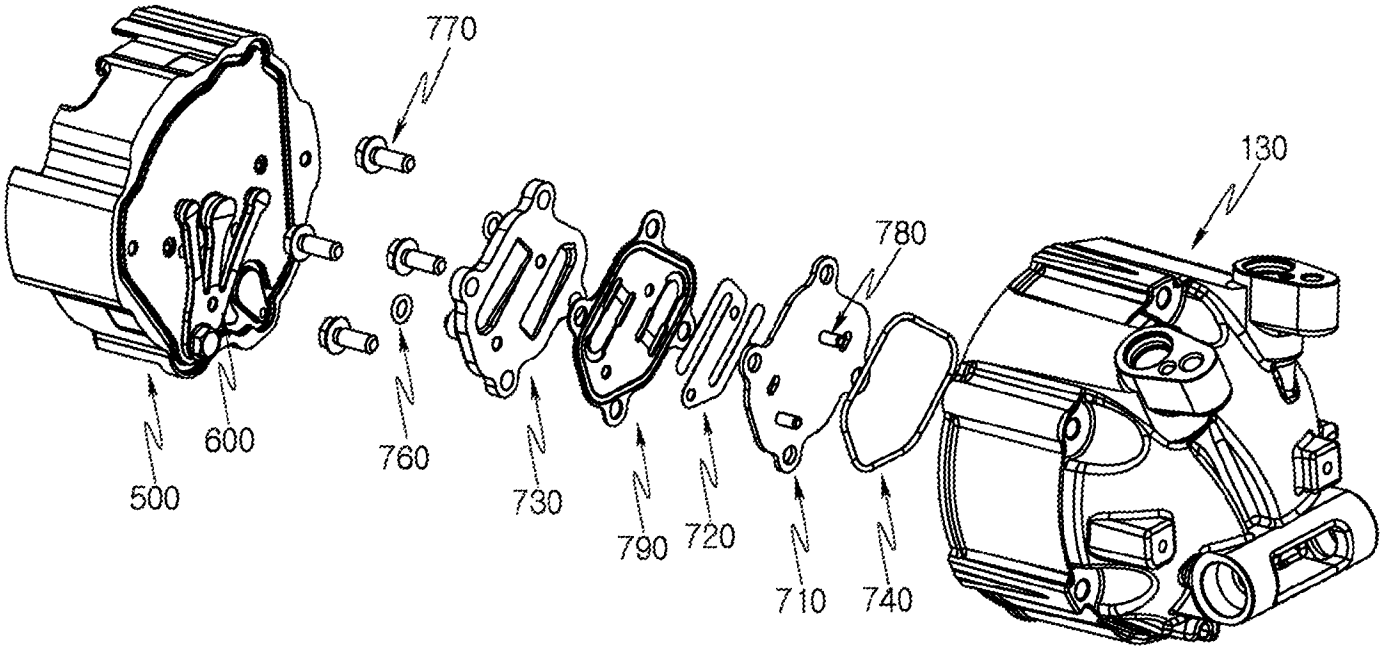
FIG. 7 is an exploded perspective view illustrating the rear housing of the scroll compressor illustrated in FIG. 2 and components accommodated in the rear housing.

Next, the discharge valve 600 will be described with reference to FIGS. 7 and 8. The discharge valve 600 is interposed between the fixed end plate 510 and the injection valve assembly 700 and serves to allow the discharge opening 512 and the discharge chamber D to communicate with each other or block the communication between the discharge opening 512 and the discharge chamber D.

The discharge valve 600 may include a main opening/closing part 610 configured to open or close the main discharge opening 512*a*, a first sub-opening/closing part 630 configured to open or close the first sub-discharge opening 512*b*, a second sub-opening/closing part 650 configured to open or close the second sub-discharge opening 512*c*, a fastening part 670 fastened to the fixed end plate 510, a main support part 620 extending from the main opening/closing part 610 to the fastening part 670, a first sub-support part 640 extending from the first sub-opening/closing part 630 to the fastening part 670, and a second sub-support part 660 extending from the second sub-opening/closing part 650 to the fastening part 670.

According to the discharge valve 600, the main opening/closing part 610, the first sub-opening/closing part 630, the second sub-opening/closing part 650, the fastening part 670, the main support part 620, the first sub-support part 640, and the second sub-support part 660 may be integrated to minimize increases in costs and weight caused by the discharge valve 600. In addition, a circumferential width of the fastening part 670 is smaller than a distance between the first sub-opening/closing part 630 and the second sub-opening/closing part 650. The fastening part 670 may be fastened to the fixed end plate 510 by means of a single fastening member 680. In this case, the single fastening member 680 may be fastened to the fixed wrap introduction part 532 having a relatively large thickness and height so that the discharge valve 600 may be sufficiently supported even though the discharge valve 600 is fastened to the fixed end plate 510 by means of the single fastening member 680.

According to the embodiment, to prevent at least one of the first sub-support part 640 and the second sub-support part 660 from interfering with the injection port 514, at least one of the first sub-support part 640 and the second sub-support part 660 may include an avoidance part indented toward the main support part 620.

In this case, when the pressure in the third compression chamber C3 reaches a level of a discharge pressure, the main opening/closing part 610 opens the main discharge opening 512*a*. In this case, when the pressure in the second outer compression chamber C21 is higher than the second pressure range, the first sub-opening/closing part 630 opens the first sub-discharge opening 512*b* to decrease the pressure in the second outer compression chamber C21 to a level included in the second pressure range. When the pressure in the second inner compression chamber C22 higher than the second pressure range, the second sub-opening/closing part 650 opens the second sub-discharge opening 512*c* to decrease the pressure in the second inner compression chamber C22 to a level included in the second pressure range. As a result, it is possible to prevent the pressure of the refrigerant discharged from the main discharge opening 512*a* from becoming excessively higher than the discharge pressure. That is, the excessive compression may be prevented.

Meanwhile, the first sub-discharge opening 512*b* and the second sub-discharge opening 512*c* may simultaneously communicate with the second outer compression chamber C21 and the second inner compression chamber C22 so that pressure imbalance does not occur between the second outer compression chamber C21 and the second inner compression chamber C22. That is, when the communication between the first sub-discharge opening 512*b* and the second outer compression chamber C21 is initiated, the communication between the second sub-discharge opening 512*c* and the second inner compression chamber C22 may be initiated.

Further, particularly, the first sub-discharge opening 512*b* and the second sub-discharge opening 512*c* may be blocked simultaneously with the second outer compression chamber C21 and the second inner compression chamber C22. That is, when the communication between the first sub-discharge opening 512*b* and the second outer compression chamber C21 is blocked, the communication between the second sub-discharge opening 512*c* and the second inner compression chamber C22 may be blocked.

Next, the injection valve assembly 700 will be described below in detail with reference to FIGS. 7 and 9 to 14. The injection valve assembly 700 may be disposed on a tip surface of the third annular wall 138 so as to allow the introduction chamber I and the injection port 514 to communicate with each other or block the communication between the introduction chamber I and the injection port 514. The injection valve assembly 700 may include an anti-leakage means together with an injection valve for opening or closing an injection flow path, thereby preventing a leakage of the refrigerant through the injection valve assembly.

Specifically, the injection valve assembly 700 may include: the cover plate 710 fastened to a tip surface of the third annular wall 138 and configured to cover the introduction chamber I; the valve plate 730 fastened to the cover plate 710 and disposed opposite to the introduction chamber I based on the cover plate 710; the gasket retainer 790 interposed, as an anti-leakage means, between the cover plate 710 and the valve plate 730; and the injection valve 720 interposed between the cover plate 710 and the gasket retainer 790.

Figure 9:
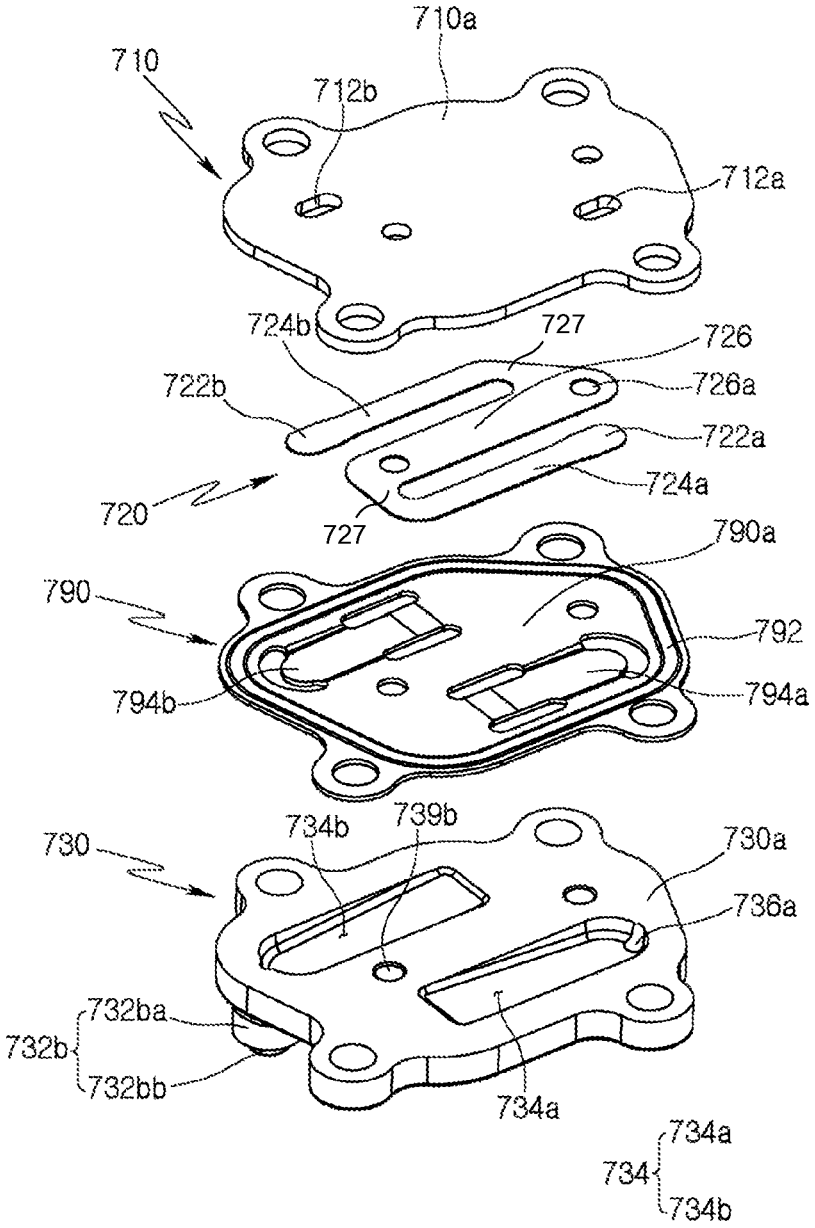
FIG. 9 is an exploded perspective view illustrating an injection valve assembly among the components illustrated in FIG. 7.
Figure 10:
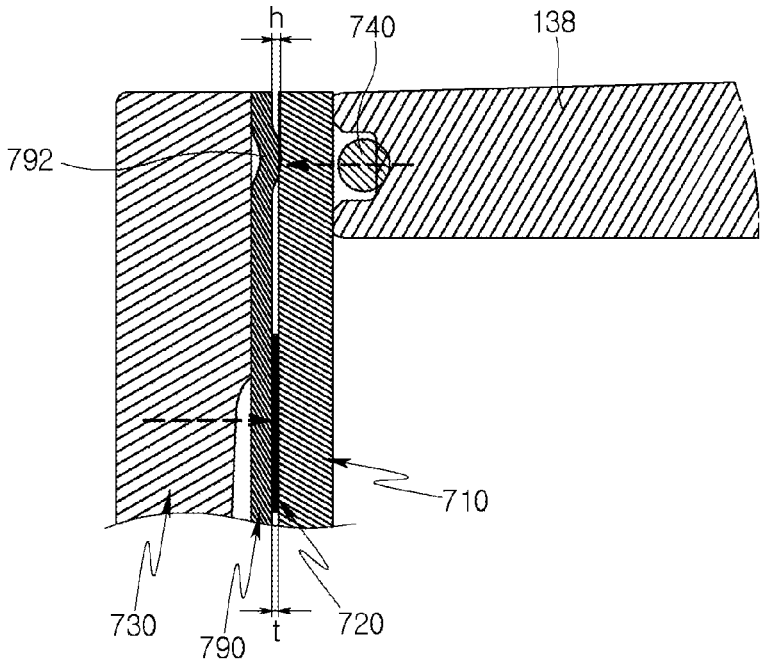
FIG. 10 is a cross-sectional view illustrating a state in which the injection valve assembly illustrated in FIG. 9 is stacked before the injection valve assembly is fastened.
Figure 11:
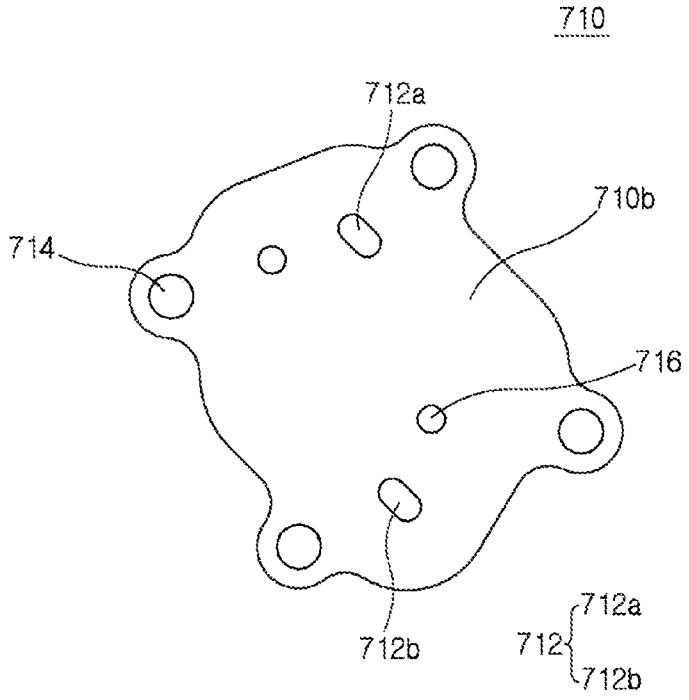
FIG. 11 is a rear view of a cover plate of the injection valve assembly illustrated in FIG. 9.

As illustrated in FIGS. 9 and 11, the cover plate 710 may include a cover plate upper surface 710*a* facing the third annular wall 138, and a cover plate lower surface 710*b* facing the gasket retainer 790.

In addition, the cover plate 710 may further include the inflow port 712 configured to allow the introduction chamber I and the inclined space 734 to be described below to communicate with each other, second fastening holes 714 configured to communicate with the fastening grooves 138*a* and be penetrated by the fastening bolts 770, and first positioning holes 716 configured to communicate with the first positioning grooves 138*b* and be penetrated by the positioning pins 780.

The inflow ports 712 are penetratively formed from the cover plate upper surface 710*a* to the cover plate lower surface 710*b*. In the present embodiment, the two inflow ports 712 are formed in a diagonal direction of the cover plate 710. That is, the inflow ports 712 include a first inflow port 712*a* configured to communicate with one side of the introduction chamber I, and a second inflow port 712*b* formed independently of the first inflow port 712*a* and configured to communicate with the other side of the introduction chamber I. In this case, the first and second inflow ports 712*a* and 712*b* may each be provided in the form of a long hole to maximize a valve lifting force and an inflow flow rate of the refrigerant.

The second fastening hole 714 may be provided in the outer peripheral portion of the cover plate 710 and penetratively formed from the cover plate upper surface 710*a* to the cover plate lower surface 710*b*. In addition, the first positioning holes 716 are formed in a diagonal direction of the cover plate 710. In particular, the first positioning holes 716 are formed in the diagonal direction that intersects a diagonal line on which the inflow ports 712 are formed. The first positioning holes 716 may be penetratively formed from the cover plate upper surface 710*a* to the cover plate lower surface 710*b*.

As illustrated in FIG. 9, the injection valve 720 may include: a first head portion 722*a* configured to open or close the first inflow port 712*a*; a first leg portion 724*a* configured to support the first head portion 722*a*; a second head portion 722*b* configured to open or close the second inflow port 712*b*; a second leg portion 724*b* configured to support the second head portion 722*b*; and a connection portion 726 configured to connect the first leg portion 724*a* and the second leg portion 724*b*. In this case, the first head portion 722*a*, the first leg portion 724*a*, the second head portion 722*b*, the second leg portion 724*b*, and the connection portion 726 may be integrated to reduce the number of components, the sizes, the costs, and the weights.

The first and second leg portions 724*a* and 724*b* are formed in parallel with each other. A connected portion 727 between the first leg portion 724*a* and the connection portion 726 and a connected portion 727 between the second leg portion 724*b* and the connection portion 726 may be formed at the opposite sides to implement the compact structure. That is, the first leg portion 724*a* and the second leg portion 724*b* are respectively connected to two opposite ends of the connection portion 726.

In addition, the connection portion 726 may include second positioning holes 726*a* configured to communicate with the first positioning holes 716 and be penetrated by the positioning pins 780. In the present embodiment, the second positioning holes 726*a* are formed at two opposite ends of the connection portion 726. However, the present disclosure is not limited thereto.

In this case, the injection valve 720 is fixed by being compressed between the cover plate 710 and the gasket retainer 790 without a separate fastening member for fixing the injection valve 720. This configuration will be described below in more detail.

Figure 12:
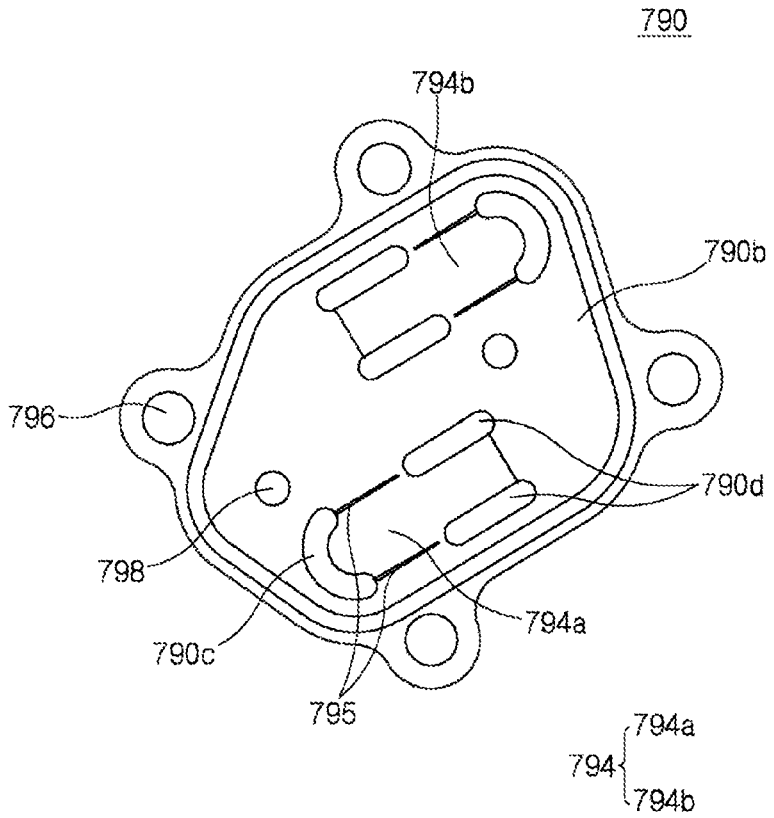
FIG. 12 is a rear view of a gasket retainer of the injection valve assembly illustrated in FIG. 9.

As illustrated in FIGS. 9 and 12, the gasket retainer 790 may include a gasket retainer upper surface 790*a* configured to face the cover plate 710 and the injection valve 720, and a gasket retainer lower surface 790*b* configured to face the fixed scroll 500 while defining a rear surface of the gasket retainer upper surface 790*a*.

Further, the gasket retainer 790 may further include a bead portion 792 protruding along a periphery of the gasket retainer upper surface 790*a*, and retainer portions 794 each serving as a retainer for the injection valve 720 and inclinedly formed on the gasket retainer 790. In this case, the retainer portion 794 is formed to be inclined in a direction in which the injection valve 720 is opened, i.e., a direction toward the valve plate 730. The retainer portions 794 are formed inside the bead portion 792.

The retainer portion 794 serves to support the head portion 722 and the leg portion 724 of the injection valve 720 when the injection valve 720 opens the inflow port 712, i.e., when the inflow port 712 is opened as the head portion 722 and the leg portion 724 of the injection valve 720 moves toward the valve plate 730. A position at which the injection valve 720 is maximally opened may be restricted depending on a predetermined inclination of the retainer portion 794. To this end, the retainer portions 794 include a first retainer portion 794*a* configured to support the first head portion 722*a* and the first leg portion 724*a*, and a second retainer portion 794*b* configured to support the second head portion 722*b* and the second leg portion 724*b*.

In this case, the first and second retainer portions 794*a* and 794*b* may be inclined in a staggered manner to correspond to the first and second leg portions 724*a* and 724*b*. That is, the first and second retainer portions 794*a* and 794*b* are inclined by means of cut-out portions in the gasket retainer 790. The cut-out portions are formed in a staggered manner.

Specifically, in the present embodiment, the cut-out portion has a 'U' shape, an inner portion, which is cut by the cut-out portion in a body of the gasket retainer 790, is inclinedly formed as the retainer portion 794.

In this case, a pair of blade portions 795 is provided at two opposite sides of the retainer portion 794 and connects the two opposite sides of the retainer portion 794 to the body of the gasket retainer 790 facing the two opposite sides of the retainer portion 754 in order to maintain an inclination angle of the retainer portion. Therefore, a main flow hole 790*c* having a 'U' shape may be formed at one side of the pair of blade portions 795, and a pair of auxiliary flow holes 790*d* may be formed at the other side of the pair of blade portions 755.

Therefore, when the injection valve 720 is opened, the refrigerant introduced into the inflow port 712 of the cover plate may flow to the inclined spaces 734 of the valve plate through the main flow hole 790*c* and the pair of auxiliary flow holes 790*d*. Because the pair of blade portion 795 is provided, the inclination angle of the retainer portion 794 may be kept constant. Further, durability may be maintained even though the injection valve 720 consistently strikes the retainer portions 794.

The gasket retainer 790 is compressed between the cover plate 710 and the valve plate 730. Therefore, the injection valve 720 may be fixed in position between the cover plate 710 and the gasket retainer 790 by being compressed, and at the same time, the gasket retainer 790 may seal a portion between the cover plate 710 and the valve plate 730.

Figure 13:
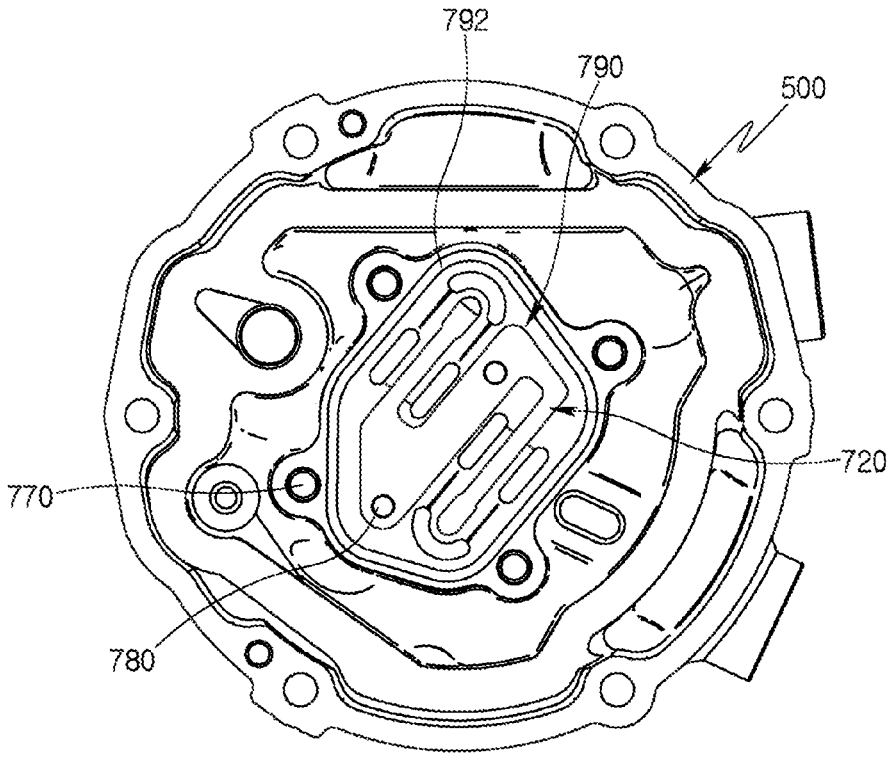
FIG. 13 is a front view illustrating the fixed scroll, the discharge valve, a valve plate, a gasket retainer, and an injection valve among the components illustrated in FIG. 7.

In particular, as illustrated in FIG. 13, the bead portion 792 protrudes from the gasket retainer upper surface 790*a* in the direction toward the cover plate 710 along the periphery of the gasket retainer 790 so as to surround the injection valve 720. Therefore, when the gasket retainer 790 is compressed between the cover plate 710 and the valve plate 730, the bead portion 792 may seal the periphery of the injection valve 720 against the cover plate 710. Moreover, when the gasket retainer 790 and the injection valve 720 are assembled between the cover plate 710 and the valve plate 730, the bead portion 792 is pressed by the cover plate 710 in a direction from the periphery of the gasket retainer toward the valve plate 730. Further, an inner portion of the gasket retainer 790, which faces the injection valve 720, is bent by receiving a force in a direction opposite to the direction in which the bead portion 792 is pressed, i.e., bent in the direction toward the injection valve 720. This configuration is indicated by the dotted arrow in FIG. 10. Therefore, the inner portion of the gasket retainer 790 may be in close contact with the injection valve 720 so as to seal the injection valve 720, thereby preventing a leak of the refrigerant. That is, a gap between the injection valve 720 and the cover plate 710 after the bead portion 792 is pressed may be smaller than a gap between the injection valve 720 and the cover plate 710 before the bead portion 792 is pressed.

To this end, a height h by which the bead portion 792 protrudes may be equal to or larger than a thickness t of the injection valve 720. If the height by which the bead portion 792 protrudes is smaller than the thickness of the injection valve 720, the bead portion 792 is not appropriately in close contact with the injection valve 720 even though the bead portion 792 is compressed and pressed. In addition, particularly, the bead portion 792 may have a shape in which straight portions are connected in a round shape without a bent shape along the circumferential direction of the gasket retainer 790, thereby improving sealability.

As described above, the bead portion 792 is disposed between the cover plate 710 and the valve plate 730 and serves to press the injection valve 720 in order to fix the position of the injection valve 720 and seal the injection valve 720.

Further, the gasket retainer 790 may further include third fastening holes 796, which are provided in an outer peripheral portion of the gasket retainer 790 and penetratively formed from the gasket retainer upper surface 790*a* to the gasket retainer lower surface 790*b*, so that the third fastening holes 796 communicate with the second fastening holes 714 and are penetrated by the fastening bolts 770. In addition, the gasket retainer 790 may further include third positioning holes 798 penetratively formed from the gasket retainer upper surface 790*a* to the gasket retainer lower surface 790*b* so that the third positioning holes 798 communicate with the second positioning holes 726*a*, and the positioning pins 780 are inserted into the third positioning holes 798. In the present embodiment, the third positioning holes 798 are formed between the first and second retainer portions 794*a* and 794*b*. However, the present disclosure is not limited thereto.

As described above, the third fastening holes 796 are formed in the outer portion of the bead portion 792 based on the radial direction, and the third positioning holes 798 are formed in the inner portion of the bead portion 792 based on radial direction. As the inner portion inside the bead portion, the gasket retainer 790 may be accurately aligned and assembled to the other components of the injection valve assembly. Further, at the outer portion outside the bead portion, the bead portion 792 is compressed by fastening forces of the fastening bolts 770, such that the sealing may be implemented.

Figure 14:
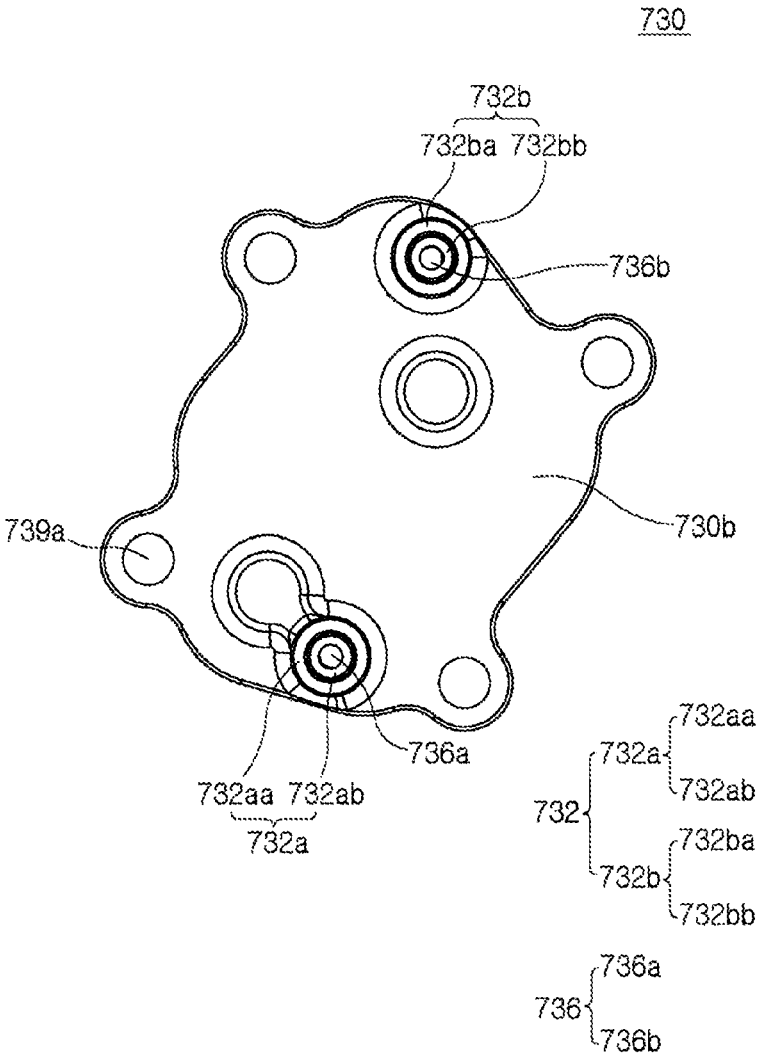
FIG. 14 is a rear view of the valve plate of the injection valve assembly illustrated in FIG. 9.

As illustrated in FIGS. 9 and 14, the valve plate 730 may include a valve plate upper surface 730*a* configured to face the gasket retainer 790, and a valve plate lower surface 730*b* configured to face the fixed scroll 500 while defining a rear surface of the valve plate upper surface 730*a*.

In addition, the valve plate 730 may further include protruding portions 732 protruding from the valve plate lower surface 730*b* toward the first injection port 514*a* and the second injection port 514*b*. That is, the valve plate 730 may include a first protruding portion 732*a* protruding from one side of the valve plate lower surface 730*b* toward the first injection port 514*a*, and a second protruding portion 732*b* protruding from the other side of the valve plate lower surface 730*b* toward the second injection port 514*b*.

In this case, the first protruding portion 732*a* may include a first large diameter portion 732*aa* protruding from one side of the valve plate lower surface 730*b* toward the first injection port 514*a*, and a first small diameter portion 732*ab* further protruding from the first large diameter portion 732*aa* toward the first injection port 514*a*. An outer diameter of the first large diameter portion 732*aa* is larger than an outer diameter of the first small diameter portion 732*ab*.

Likewise, the second protruding portion 732*b* may also include a second large diameter portion 732*ba* protruding from the other side of the valve plate lower surface 730*b* toward the second injection port 514*b*, and a second small diameter portion 732*bb* further protruding from the second large diameter portion 732*ba* toward the second injection port 514*b*. An outer diameter of the second large diameter portion 732*ba* is larger than an outer diameter of the second small diameter portion 732*bb*.

In addition, the valve plate 730 may further include: a first inclined space 734*a* configured to accommodate the refrigerant introduced through the first inflow port 712*a*; a second inclined space 734*b* configured to accommodate the refrigerant introduced through the second inflow port 712*b*; a first outflow port 736*a* formed in the first protruding portion 732*a* and configured to guide the refrigerant in the first inclined space 734*a* to the first injection port 514*a*; and a second outflow port 736*b* formed in the second protruding portion 732*b* and configured to guide the refrigerant in the second inclined space 734*b* to the second injection port 514*b*.

The first and second inclined spaces 734*a* and 734*b* may be recessed from the valve plate upper surface 730*a*. In addition, the first and second inclined spaces 734*a* and 734*b* may be separated from each other and formed to be inclined in a staggered manner while corresponding to the first and second retainer portions 794*a* and 794*b* so that the first and second retainer portions 794*a* and 794*b* may be seated in the first and second inclined spaces 734*a* and 734*b*.

The first outflow port 736*a* is recessed from a tip surface of the first protruding portion 732*a*, more accurately, a tip surface of the first small diameter portion 732*ab*. The first outflow port 736*a* may extend to the first large diameter portion 732*aa* and communicate with the first inclined space 734*a*. The second outflow port 736*b* is recessed from a tip surface of the second protruding portion 732*b*, more accurately, a tip surface of the second small diameter portion 732*bb*. The second outflow port 736*b* may extend to the second large diameter portion 732*ba* and communicate with the second inclined space 734*b*.

However, the present disclosure is not limited thereto. The first inclined space 734*a* and the first outflow port 736*a* may of course be connected by means of a separate connection flow path, and the second inclined space 734*b* and the second outflow port 736*b* may of course be connected by means of a separate connection flow path.

As illustrated in FIG. 3, the valve plate lower surface 730*b* is spaced apart from the fixed end plate 510 so that the discharge valve 600 is interposed between the fixed end plate 510 and the valve plate lower surface 730*b* and the refrigerant discharged from the discharge opening 512 flows into the discharge chamber D.

Further, the valve plate 730 may further include first fastening holes 739*a*, which are provided in an outer peripheral portion of the valve plate 730 and penetratively formed from the valve plate upper surface 730*a* to the valve plate lower surface 730*b*, so that the first fastening holes 739*a* communicate with the third fastening holes 796 and are penetrated by the fastening bolts 770. In addition, the valve plate 730 may further include second positioning grooves 739*b* recessed from the valve plate upper surface 730*a* so that the second positioning grooves 739*b* communicate with the third positioning holes 798 and the positioning pins 780 are inserted into the second positioning grooves 739*b*.

Therefore, one end of the positioning pin 780 penetrates the first positioning hole 716 and is inserted into the first positioning groove 138*b*, and the other end of the positioning pin 780 penetrates the second positioning hole 726*a* and the third positioning hole 798 and is inserted into the second positioning groove 739*b*, such that the cover plate 710, the injection valve 720, the gasket retainer 790, and the valve plate 730 of the injection valve assembly 700 may be aligned. In addition, the fastening bolt 770 penetrates the first fastening hole 739*a*, the third fastening hole 796, and the second fastening hole 714 and is fastened to the fastening groove 138*a*, such that the injection valve assembly 700 may be fastened to the rear housing 130.

Meanwhile, a first sealing member 740 is interposed between the cover plate upper surface 710*a* and the third annular wall 138 when the injection valve assembly 700 is fastened to the rear housing 130. Because the portion between the cover plate lower surface 710*b* and the valve plate upper surface 730*a* are sealed by the gasket retainer 790, no separate sealing member is required.

Figure 15:
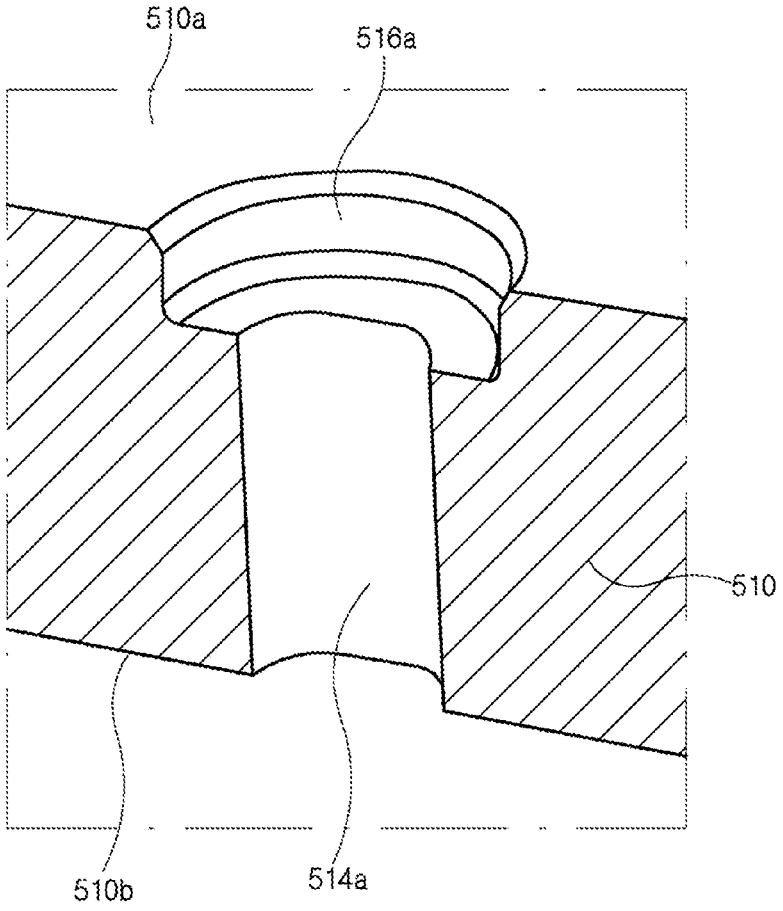
FIG. 15 is a perspective view taken along line I-I in FIG. 8.

Meanwhile, as illustrated in FIGS. 3 and 15, the fixed end plate 510 may further include a small diameter portion insertion groove 516 to prevent a leak of the refrigerant when the refrigerant flows from the injection valve assembly 700 to the first injection port 514*a* and the second injection port 514*b*. That is, the fixed end plate 510 may further include a first small diameter portion insertion groove 516*a* into which the first small diameter portion 732*ab* is inserted, and a second small diameter portion insertion groove 516*b* into which the second small diameter portion 732*bb* is inserted.

Specifically, the fixed end plate 510 may include a fixed end plate upper surface 510*a* configured to face the injection valve assembly 700, and a fixed end plate lower surface 510*b* configured to define a rear surface of the fixed end plate upper surface 510*a* and face the orbiting scroll 400.

The first small diameter portion insertion groove 516*a* may be recessed from the fixed end plate upper surface 510*a* toward the fixed end plate lower surface 510*b*, and the first small diameter portion 732*ab* may be inserted into the first small diameter portion insertion groove 516*a*. The first injection port 514*a* may be recessed from the fixed end plate lower surface 510*b* toward the fixed end plate upper surface 510*a* and communicate with the first small diameter portion insertion groove 516*a*.

The second small diameter portion insertion groove 516*b* recessed from the fixed end plate upper surface 510*a* toward the fixed end plate lower surface 510*b*, and the second small diameter portion 732*bb* may be inserted into the second small diameter portion insertion groove 516*b*. The second injection port 514*b* may be recessed from the fixed end plate lower surface 510*b* toward the fixed end plate upper surface 510*a* and communicate with the second small diameter portion insertion groove 516*b*.

In this case, an inner diameter of the first small diameter portion 732*ab* (an inner diameter of the first outflow port 736*a*) may be equal to or larger than an inner diameter of the first injection port 514*a*, and an inner diameter of the first small diameter portion insertion groove 516*a* may be equal in level to an outer diameter of the first small diameter portion 732*ab*, such that the first small diameter portion 732*ab* may be inserted into the first small diameter portion insertion groove 516*a*, and a loss of pressure and flow rate does not occur while the refrigerant flows from the injection valve assembly 700 to the first injection port 514*a*.

In addition, an inner diameter of the second small diameter portion 732*bb* (an inner diameter of the second outflow port 736*b*) may be equal to or larger than an inner diameter of the second injection port 514*b*, and an inner diameter of the second small diameter portion insertion groove 516*b* may be equal in level to an outer diameter of the second small diameter portion 732*bb* so that the second small diameter portion 732*bb* may be inserted into the second small diameter portion insertion groove 516*b*, and a loss of pressure and flow rate does not occur while the refrigerant flows from the injection valve assembly 700 to the second injection port 514*b*.

Meanwhile, an outer diameter of the first large diameter portion 732*aa* may be larger than an inner diameter of the first small diameter portion insertion groove 516*a* so that the first large diameter portion 732*aa* is not inserted into the first small diameter portion insertion groove 516*a*. Therefore, when the injection valve assembly 700 is fastened to the fixed scroll 500, a third sealing member 760 may be interposed between a tip surface of the first large diameter portion 732*aa* and the fixed end plate upper surface 510*a*. A thickness of the third sealing member 760, before the third sealing member 760 is deformed, may be equal to or larger than a gap between the tip surface of the first large diameter portion 732*aa* and the fixed end plate upper surface 510*a* so that the third sealing member 760 may be compressed between the tip surface of the first large diameter portion 732*aa* and the fixed end plate upper surface 510*a*.

Further, a protruding length of the first small diameter portion 732*ab* (i.e., an axial distance the tip surface of the first large diameter portion 732*aa* and the tip surface of the first small diameter portion 732*ab*) may be larger than a thickness of the third sealing member 760 before the deformation of the third sealing member 760 and equal to or smaller than a sum of the thickness of the third sealing member 760 before the deformation of the third sealing member 760 and an axial depth of the first small diameter portion insertion groove 516*a*. Therefore, the tip surface of the first small diameter portion 732*ab* does not come into contact with a base surface of the first small diameter portion insertion groove 516*a*, and the third sealing member 760 may be compressed between the tip surface of the first large diameter portion 732*aa* and the fixed end plate upper surface 510*a*.

Likewise, an outer diameter of the second large diameter portion 732*ba* may be larger than an inner diameter of the second small diameter portion insertion groove 516*b* so that the second large diameter portion 732*ba* is not inserted into the second small diameter portion insertion groove 516*b*. Therefore, when the injection valve assembly 700 is fastened to the fixed scroll 500, the third sealing member 760 may be interposed and compressed between the tip surface of the second large diameter portion 732*ba* and the fixed end plate upper surface 510*a*.

Further, a protruding length of the second small diameter portion 732*bb* (i.e., an axial distance between the tip surface of the second large diameter portion 732*ba* and the tip surface of the second small diameter portion 732*bb* may be larger than a thickness of the third sealing member 760 before the deformation of the third sealing member 760 and equal to or smaller than a sum of the thickness of the third sealing member 760 before the deformation of the third sealing member 760 and an axial depth of the second small diameter portion insertion groove 516*b*. Therefore, the tip surface of the second small diameter portion 732*bb* does not come into contact with a base surface of the second small diameter portion insertion groove 516*b*, and the third sealing member 760 may be compressed between the tip surface of the second large diameter portion 732*ba* and the fixed end plate upper surface 510*a*.

Figure 8:
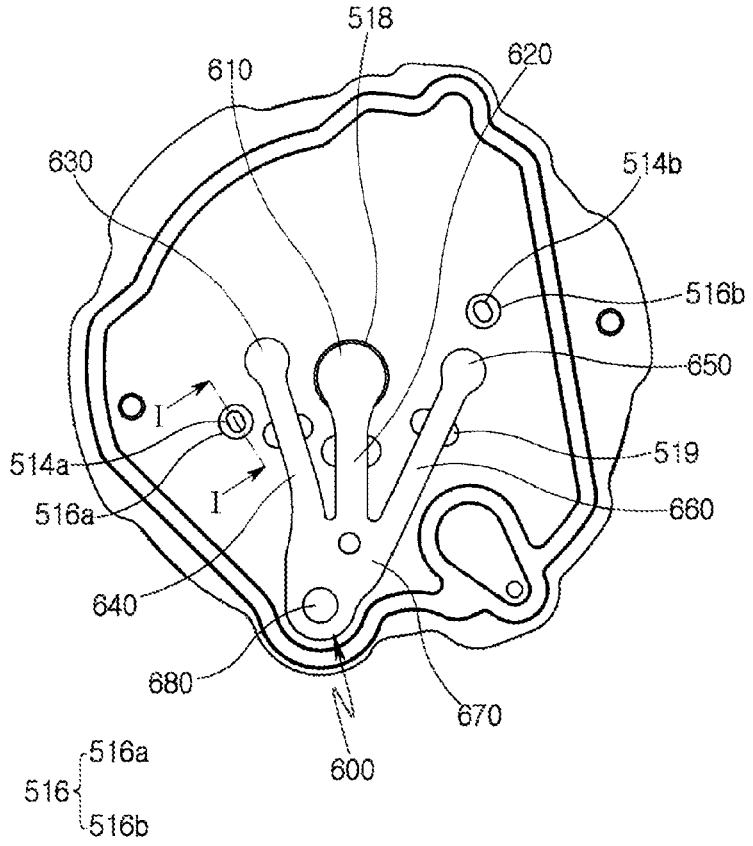
FIG. 8 is a front view illustrating a fixed scroll and a discharge valve among the components illustrated in FIG. 7.

Meanwhile, as illustrated in FIG. 8, the fixed end plate 510 may have a third groove 518 and a fourth groove 519.

The third groove 518 serves to reduce a contact area between the fixed end plate 510 and the main opening/closing part 610 of the discharge valve 600 to reduce collision noise. The third groove 518 serves to capture and discharge foreign substances to prevent the foreign substances from being trapped between the fixed end plate 510 and the main opening/closing part 610. The third groove 518 may have an annular shape that is recessed from the fixed end plate upper surface 510*a* and surrounds the main discharge opening 512*a*. An inner peripheral portion of the third groove 518 may overlap an outer peripheral portion of the main opening/closing part 610 in the axial direction. An outer peripheral portion of the third groove 518 may not overlap the main opening/closing part 610 in the axial direction. That is, an inner diameter of the third groove 518 may be smaller than an outer diameter of the main opening/closing part 610, and an outer diameter of the third groove 518 may be larger than an outer diameter of the main opening/closing part 610. This is to discharge foreign substances, which are captured in the third groove 518, to the discharge chamber D.

The fourth groove 519 serves to capture and discharge foreign substances to prevent the foreign substances from being trapped between the fixed end plate 510 and the main support part 620, the first sub-support part 640, and the second sub-support part 660 (hereinafter, referred to as 'support parts') of the discharge valve 600. The fourth groove 519 may be recessed from the fixed end plate upper surface 510*a* and provided at a position facing the support part of the discharge valve 600. The fourth groove 519 may be provided in the form of a long hole. A central portion of the fourth groove 519 may overlap the support part of the discharge valve 600 in the axial direction. Two opposite ends of the fourth groove 519 may not overlap the support part of the discharge valve 600 in the axial direction. That is, a major axis direction of the fourth groove 519 may be parallel to a width direction of the support part of the discharge valve 600, and a major axis length of the fourth groove 519 may be larger than a width of the support part of the discharge valve 600. This is to discharge foreign substances, which are captured in the fourth groove 519, to the discharge chamber D.

Hereinafter, an operational effect of the scroll compressor according to the present embodiment will be described.

When power is applied to the motor 200, the rotary shaft 300 rotates together with the rotor 220, and the orbiting scroll 400 orbits by receiving a rotational force from the rotary shaft 300 through the eccentric bushing 310. Therefore, the compression chamber C moves consistently toward the center, such that a volume of the compression chamber C may be reduced.

Therefore, the refrigerant introduced into the compression chamber C may be compressed while moving toward the center along the movement route of the compression chamber C and discharged to the discharge chamber D through the discharge opening 512. The discharge-pressure refrigerant discharged to the discharge chamber D may be discharged to the outside of the compressor through the discharge port 131.

In this case, the suction-pressure refrigerant may flow into the compression chamber C through the suction port (not illustrated), the motor accommodation space S1, the suction flow path (not illustrated), and the scroll accommodation space S2.

In addition, the scroll compressor according to the present embodiment includes the injection flow path (the introduction port 133, the introduction chamber I, the injection valve assembly 700, and the injection port 514) configured to guide the middle-pressure refrigerant to the compression chamber C. Therefore, the scroll compressor may compress and discharge the middle-pressure refrigerant as well as the suction-pressure refrigerant. That is, the introduced refrigerant introduced into the housing 100 through the evaporator is introduced into the compression chamber C through the front housing 120. The refrigerant in the middle-pressure state may be introduced from the outside of the housing 100 and introduced into the compression chamber C through the injection flow path before at least a part of the refrigerant discharged to the outside of the housing 100 passes through the evaporator. Therefore, in comparison with the case in which only the refrigerant at the suction pressure is introduced, compressed, and discharged, the discharge amount of refrigerant may be increased, and the performance and efficiency of the compressor may be improved.

In addition, the rear housing 130 includes the introduction port 133 and the introduction chamber I as well as the discharge chamber D and the discharge port 131. That is, the rear housing 130 having the discharge chamber D, the discharge port 131, the introduction port 133, and the introduction chamber I is integrally formed, such that the likelihood of the refrigerant is reduced, and the size, costs and weight may be reduced.

In addition, since at least a part of the introduction chamber I is accommodated in the discharge chamber D, the refrigerant guided to the injection port 514 may exchange heat with the refrigerant in the discharge chamber D through the third annular wall 138 and the injection valve assembly 700. That is, the refrigerant in the introduction chamber I and the refrigerant passing through the injection valve assembly 700 may be heated by receiving heat from the refrigerant in the discharge chamber D. Therefore, it is possible to prevent the liquid refrigerant from being injected into the compression chamber C through the injection port 514.

In addition, at least a part of the discharge port 131 is accommodated in the introduction chamber I, the refrigerant in the introduction chamber I may exchange heat with the refrigerant in the discharge port 131 through the wall portion of the discharge port 131 accommodated in the introduction chamber I. That is, the refrigerant in the introduction chamber I may be heated by receiving heat from the refrigerant of the discharge port 131. Therefore, it is possible to prevent the liquid refrigerant from being injected into the compression chamber C through the injection port 514.

In addition, since at least a part of the introduction port 133 is accommodated in the discharge chamber D, the refrigerant in the introduction port 133 may exchange heat with the refrigerant in the discharge chamber D through the wall portion of the introduction port 133 accommodated in the discharge chamber D. That is, the refrigerant in the introduction port 133 may be heated by receiving heat from the refrigerant in the discharge chamber D. Therefore, it is possible to prevent the liquid refrigerant from being injected into the compression chamber C through the injection port 514.

In addition, since the refrigerant in the discharge port 131 and the refrigerant in the introduction port 133 flow in a cross-flow direction, the refrigerant in the introduction port 133 may exchange heat with the refrigerant in the discharge port 131. That is, the refrigerant in the introduction port 133 may be heated by receiving heat from the refrigerant in the discharge port 131. Therefore, it is possible to prevent the liquid refrigerant from being injected into the compression chamber C through the injection port 514.

The structure of the injection valve assembly of the scroll compressor according to the present disclosure is not limited to the above-mentioned embodiment.

In the embodiment, the injection valve assembly 700 is configured to guide the refrigerant, which is introduced from one side of the introduction chamber I, to the first injection port 514*a*, and independently guide the refrigerant, which is introduced from the other side of the introduction chamber I, to the second injection port 514*b*. That is, the two inflow ports 712, the two head portions 722 of the injection valve 720, the two leg portions 724, the two retainer portions 794, and the two inclined spaces 734 are provided.

In this case, because the refrigerant of the introduction chamber I is independently guided to the first injection port 514*a* and the second injection port 514*b*, a flow rate of the refrigerant distributed to the first injection port 514*a* and a flow rate of the refrigerant distributed to the second injection port 514*b* may become equal to each other.

However, according to another embodiment, the injection valve assembly may be configured to divide the refrigerant, in the single inclined space, introduced from the introduction chamber I and guide the refrigerants to the first injection port 514*a* and the second injection port 514*b*.

Specifically, an injection valve assembly 1700 according to another embodiment will be described with reference to FIG. 16, a cover plate 1710 has two inflow ports 1712, and an injection valve 1720 has two head portions 1722 and two leg portions 1724. However, unlike the above-mentioned description, the first inflow port 1712*a* and the second inflow port 1712*b* are formed side by side at one side of the cover plate 1710. Therefore, the first head portion 1722*a* and the first leg portion 1724*a* for opening or closing the first inflow port 1712*a* and the second head portion 1722*b* and the second leg portion 1724*b* for opening or closing the second inflow port 1712*b* may be formed side by side in the same direction without being formed in a staggered manner. In the present embodiment, a connection portion 1726 configured to connect the first leg portion 1724*a* and the second leg portion 1724*b* has a straight shape. However, the present disclosure is not limited thereto. That is, a connected portion 1727 between the first leg portion 1724*a* and the connection portion 1726 and a connected portion 1727 between the second leg portion 1724*b* and the connection portion 1726 are formed at the same side.

In contrast, the gasket retainer 1790 may have a single retainer portion 1794, and the valve plate 1730 may have a single inclined space 1734. This is because both the first head portion 1722*a* and the second head portion 1722*b* of the injection valve 1720 may be opened in the same direction.

As described above, the single retainer portion 1794 may simultaneously support the first head portion 1722*a* and the first leg portion 1724*a* and the second head portion 1722*b* and the second leg portion 1724*b* of the injection valve 1720. The refrigerant introduced through the first inflow port 1712*a* and the second inflow port 1712*b* is collected into the single inclined space 1734. Thereafter, the refrigerant may be guided to the injection ports by being distributed through the first outflow port 1736*a* and the second outflow port 1736*b* that respectively communicate with the first injection port 514*a* and the second injection port 514*b* in the single inclined space 1734.

Figure 16:
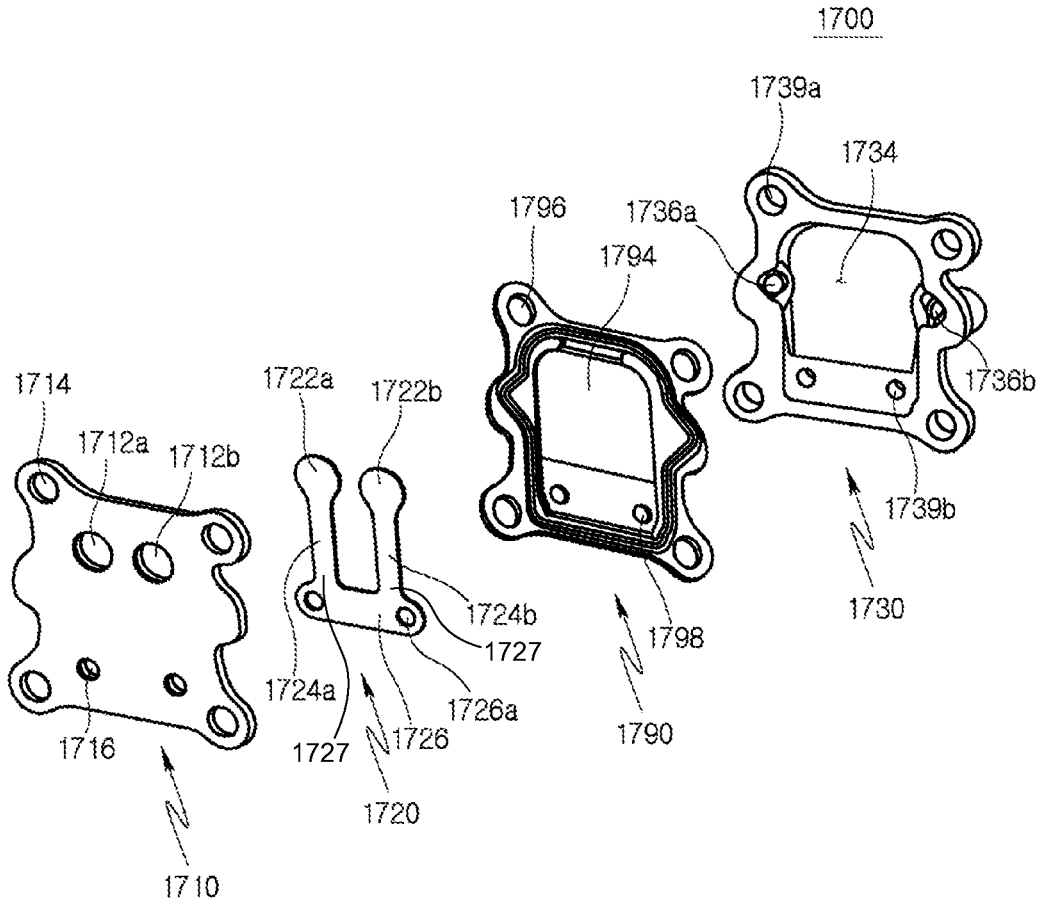
FIG. 16 is an exploded perspective view illustrating an injection valve assembly according to another embodiment of the present disclosure.

In this case, second fastening holes 1714 and first positioning holes 1716 of the cover plate 1710, second positioning holes 1726*a* of the injection valve 1720, third fastening holes 1796 and third positioning holes 1798 of the gasket retainer 1790, and first fastening holes 1739*a* and second positioning grooves 1739*b* of the valve plate 1730 may be appropriately changed in accordance with the embodiment illustrated in FIG. 16.

Meanwhile, in the above-mentioned embodiment, the orbiting scroll 400 and the fixed scroll 500 are accommodated in the rear housing 130. However, the present disclosure is not limited thereto. That is, the fixed scroll 500 may be exposed to the outside while being interposed between the rear housing 130 and the center housing 110. The orbiting scroll 400 may be accommodated in the fixed scroll 500.

According to the present disclosure, not only the suction-pressure refrigerant but also the middle-pressure refrigerant is introduced into the compression chamber C of the scroll compressor, such that the amount of refrigerant to be discharged from the compression chamber may increase, which makes it possible to improve performance and efficiency of the compressor.

The present disclosure is not limited to the specific exemplary embodiments and descriptions, various modifications can be made by any person skilled in the art to which the present disclosure pertains without departing from the subject matter of the present disclosure.

The present disclosure relates to a scroll compressor, and more particularly, to a scroll compressor capable of compressing a refrigerant by using a fixed scroll and an orbiting scroll.

The invention claimed is:

1. A scroll compressor comprising:
- a housing;
- a motor provided in the housing;
- a rotary shaft configured to be rotated by the motor;
- an orbiting scroll configured to orbit in conjunction with the rotary shaft; and
- a fixed scroll configured to define compression chambers together with the orbiting scroll,
- wherein the housing further comprises:
  - a center housing penetrated by the rotary shaft;
  - a front housing configured to define, together with the center housing, a motor accommodation space that accommodates the motor; and
  - a rear housing configured to define a discharge chamber that accommodates a refrigerant discharged from the compression chambers, and wherein an injection valve assembly is provided between the fixed scroll and the rear housing, and the injection valve assembly further comprises an anti-leakage means and an injection valve configured to open or close an injection flow path that guides the refrigerant, which is introduced from outside of the housing, to the compression chambers,
- wherein the injection valve assembly further comprises:
  - a cover plate coupled to the rear housing and having an inflow port into which the refrigerant is introduced; and
  - a valve plate coupled to the cover plate and having an outflow port through which the refrigerant introduced through the inflow port is discharged, wherein the anti-leakage means further comprises a gasket retainer interposed between the cover plate and the valve plate, wherein the injection valve is interposed between the cover plate and the gasket retainer and configured to open or close the inflow port, and wherein a valve plate lower surface facing the fixed scroll is spaced apart from the fixed scroll, and the valve plate further includes a protruding portion protruding from the valve plate lower surface toward the fixed scroll and through which the outflow port is formed.

2. The scroll compressor of claim 1, wherein the gasket retainer comprises a bead portion protruding from a gasket retainer upper surface facing the cover plate, and the bead portion surrounds the injection valve.

3. The scroll compressor of claim 2, wherein the gasket retainer and the injection valve are compressed between the cover plate and the valve plate.

4. The scroll compressor of claim 3, wherein when the gasket retainer and the injection valve are assembled between the cover plate and the valve plate, the bead portion is pressed by the cover plate in a direction toward the valve plate, and an inner portion of the gasket retainer, which faces the injection valve, is bent in a direction toward the injection valve.

5. The scroll compressor of claim 4, wherein a gap between the injection valve and the cover plate after the bead portion is pressed is smaller than a gap between the injection valve and the cover plate before the bead portion is pressed.

6. The scroll compressor of claim 4, wherein a height h by which the bead portion protrudes is equal to or larger than a thickness t of the injection valve.

7. The scroll compressor of claim 2, wherein the gasket retainer further comprises one or more retainer portions inclined in a direction in which the injection valve is opened.

8. The scroll compressor of claim 7, wherein the valve plate further comprises one or more inclined spaces that correspond to the one or more retainer portions and accommodates the refrigerant introduced through the inflow port.

9. The scroll compressor of claim 8, wherein the fixed scroll further comprises an injection port configured to guide the refrigerant, which is discharged from the outflow port, to the compression chambers, and the outflow port guides the refrigerant in the one or more inclined spaces to the injection port.

10. The scroll compressor of claim 9, wherein the inflow port comprises:

a first inflow port; and a second inflow port formed independently of the first inflow port, wherein the injection valve comprises:

a first head portion configured to open or close the first inflow port;

a first leg portion configured to support the first head portion;

a second head portion configured to open or close the second inflow port;

a second leg portion configured to support the second head portion; and a connection portion configured to connect the first leg portion and the second leg portion, wherein the one or more retainer portions is configured as a single retainer portion configured to support the first head portion, the first leg portion, the second head portion, and the second leg portion when the injection valve opens the inflow port, and wherein the one or more inclined spaces is configured as a single inclined space configured to accommodate the refrigerant introduced through the first inflow port and the second inflow port.

11. The scroll compressor of claim 10, wherein a connected portion between the first leg portion and the connection portion and a connected portion between the second leg portion and the connection portion are formed at the same side.

12. The scroll compressor of claim 7, wherein the one or more retainer portions is inclined by a cut-out portion in a body of the gasket retainer.

13. The scroll compressor of claim 12, wherein the gasket retainer comprises one or more blade portions configured to connect the one or more retainer portions and the body of the gasket retainer that faces the one or more retainer portions.

14. The scroll compressor of claim 7, wherein the one or more retainer portions is inclined by a cut-out portion in a body of the gasket retainer, and the gasket retainer further comprises a pair of blade portions configured to connect two opposite sides of the one or more retainer portions and the body of the gasket retainer that faces the two opposite sides of the one or more retainer portions.

15. The scroll compressor of claim 14, wherein a main flow hole is formed at one side of the pair of blade portions, and a pair of auxiliary flow holes each having a straight shape is formed at the other side of the pair of blade portions.

16. The scroll compressor of claim 1, wherein the refrigerant is introduced into the front housing and introduced into the compression chambers, and at least a part of the refrigerant discharged to the outside of the housing is introduced in a middle-pressure state from the outside of the housing and introduced into the compression chambers through the injection flow path.

17. A scroll compressor comprising:

a housing;

a motor provided in the housing;

a rotary shaft configured to be rotated by the motor;

an orbiting scroll configured to orbit in conjunction with the rotary shaft; and a fixed scroll configured to define compression chambers together with the orbiting scroll, wherein the housing further comprises:

a center housing penetrated by the rotary shaft;

a front housing configured to define, together with the center housing, a motor accommodation space that accommodates the motor; and a rear housing configured to define a discharge chamber that accommodates a refrigerant discharged from the compression chambers, and wherein an injection valve assembly is provided between the fixed scroll and the rear housing, and the injection valve assembly further comprises an anti-leakage means and an injection valve configured to open or close an injection flow path that guides the refrigerant, which is introduced from outside of the housing, to the compression chambers, wherein the injection valve assembly further comprises:

a cover plate coupled to the rear housing and having an inflow port into which the refrigerant is introduced; and a valve plate coupled to the cover plate and having an outflow port through which the refrigerant introduced through the inflow port is discharged, wherein the anti-leakage means further comprises a gasket retainer interposed between the cover plate and the valve plate, and wherein the injection valve is interposed between the cover plate and the gasket retainer and configured to open or close the inflow port, wherein the gasket retainer comprises a bead portion protruding from a gasket retainer upper surface facing the cover plate, and the bead portion surrounds the injection valve, wherein the gasket retainer further comprises:

a third fastening hole penetratively formed in an outer portion of the bead portion based on a radial direction so that a fastening bolt is inserted into the third fastening hole; and a third positioning hole penetratively formed in an inner portion of the bead portion based on the radial direction so that a positioning pin is inserted into the third positioning hole.

18. A scroll compressor comprising:

a housing;

a motor provided in the housing;

a rotary shaft configured to be rotated by the motor;

an orbiting scroll configured to orbit in conjunction with the rotary shaft; and a fixed scroll configured to define compression chambers together with the orbiting scroll, wherein the housing further comprises:

a center housing penetrated by the rotary shaft;

a front housing configured to define, together with the center housing, a motor accommodation space that accommodates the motor; and a rear housing configured to define a discharge chamber that accommodates a refrigerant discharged from the compression chambers, and wherein an injection valve assembly is provided between the fixed scroll and the rear housing, and the injection valve assembly further comprises an anti-leakage means and an injection valve configured to open or close an injection flow path that guides the refrigerant, which is introduced from outside of the housing, to the compression chambers, wherein the injection valve assembly further comprises:

a cover plate coupled to the rear housing and having an inflow port into which the refrigerant is introduced; and a valve plate coupled to the cover plate and having an outflow port through which the refrigerant introduced through the inflow port is discharged, wherein the anti-leakage means further comprises a gasket retainer interposed between the cover plate and the valve plate, and wherein the injection valve is interposed between the cover plate and the gasket retainer and configured to open or close the inflow port, wherein the gasket retainer comprises a bead portion protruding from a gasket retainer upper surface facing the cover plate, and the bead portion surrounds the injection valve, wherein the gasket retainer further comprises one or more retainer portions inclined in a direction in which the injection valve is opened, wherein the valve plate further comprises one or more inclined spaces that correspond to the one or more retainer portions and accommodates the refrigerant introduced through the inflow port, wherein the fixed scroll further comprises an injection port configured to guide the refrigerant, which is discharged from the outflow port, to the compression chambers, and the outflow port guides the refrigerant in the one or more inclined spaces to the injection port, wherein the inflow port further comprises:

a first inflow port; and a second inflow port formed independently of the first inflow port, wherein the injection valve comprises:

a first head portion configured to open or close the first inflow port;

a first leg portion configured to support the first head portion;

a second head portion configured to open or close the second inflow port;

a second leg portion configured to support the second head portion; and a connection portion configured to connect the first leg portion and the second leg portion, wherein the one or more retainer portions comprises:

a first retainer portion configured to support the first head portion and the first leg portion when the injection valve opens the inflow port; and a second retainer portion configured to support the second head portion and the second leg portion, and wherein the one or more inclined spaces comprises:

a first inclined space configured to accommodate the refrigerant introduced through the first inflow port; and a second inclined space configured to accommodate the refrigerant introduced through the second inflow port.

19. The scroll compressor of claim 18, wherein a connected portion between the first leg portion and the connection portion and a connected portion between the second leg portion and the connection portion are formed at opposite sides.

* * * * *